US006299686B1

(12) United States Patent
Mills

(10) Patent No.: US 6,299,686 B1
(45) Date of Patent: Oct. 9, 2001

(54) DRYWALL TAPING AND TEXTURE SYSTEM USING PUMP

(76) Inventor: Gregory B. Mills, Rte. 1, Box 156, Seneca, MO (US) 64865

( * ) Notice: Subject to any disclaimer, the term of this patent is extended or adjusted under 35 U.S.C. 154(b) by 0 days.

(21) Appl. No.: 09/113,002

(22) Filed: Jul. 9, 1998

Related U.S. Application Data

(60) Provisional application No. 60/052,261, filed on Jul. 11, 1997.

(51) Int. Cl.[7] ..... B05C 1/00

(52) U.S. Cl. ..... 118/207; 156/575; 92/92; 417/900; 417/118

(58) Field of Search ..... 417/90, 93, 118, 417/120, 143, 900; 141/25, 181, 221; 118/DIG. 17, 207; 156/71, 575; 92/92

(56) References Cited

U.S. PATENT DOCUMENTS

| | | | | |
|---|---|---|---|---|
| 2,413,684 | | 1/1947 | Ames . | |
| 2,509,570 | | 5/1950 | Lee . | |
| 2,741,220 | | 4/1956 | Belisle . | |
| 2,956,839 | | 10/1960 | Hermanns . | |
| 3,057,517 | | 10/1962 | Douglas . | |
| 3,174,658 | | 3/1965 | Wittenberg et al. . | |
| 3,342,377 | | 9/1967 | Peredy . | |
| 3,343,202 | | 9/1967 | Ames . | |
| 3,344,770 | | 10/1967 | Schaefer . | |
| 3,659,675 | | 5/1972 | Edelstein et al. . | |
| 3,669,070 | | 6/1972 | Wallace . | |
| 3,704,962 | * | 12/1972 | Weeks | 417/143 |
| 3,707,427 | | 12/1972 | Erickson . | |
| 3,951,572 | * | 4/1976 | Ray | 417/389 |
| 4,105,490 | | 8/1978 | Lass . | |
| 4,109,831 | | 8/1978 | Culpepper et al. . | |
| 4,111,613 | | 9/1978 | Sperry . | |
| 4,196,028 | | 4/1980 | Mills et al. . | |
| 4,202,288 | | 5/1980 | Davy, Jr. . | |
| 4,689,107 | | 8/1987 | Entwistle . | |
| 4,828,180 | * | 5/1989 | Kristensen | 239/348 |
| 4,996,941 | | 3/1991 | Mills . | |
| 5,060,826 | | 10/1991 | Coleman . | |
| 5,137,752 | | 8/1992 | Mills . | |
| 5,252,041 | * | 10/1993 | Schumack | 417/395 |
| 5,497,812 | | 3/1996 | Orosco et al. . | |
| 5,897,295 | * | 4/1999 | Rogers et al. | 417/12 |
| 5,964,580 | * | 10/1999 | Taga . | |

* cited by examiner

*Primary Examiner*—Brenda A. Lamb
(74) *Attorney, Agent, or Firm*—Pillsbury Winthrop LLP

(57) ABSTRACT

A drywall taping and texture system for pumping drywall mastic material from a container filled with the drywall mastic material to a work surface includes a pump housing, an air compressor, a tool for applying the drywall mastic material to the work surface, material and control lines, an inflatable bladder, an air release mechanism, and an airway. The pump housing is immersed in the container filled with the drywall mastic material, and the air compressor is connected to the pump housing. The material and control lines are connected between the pump housing and the tool such that there is material and air flow communication, respectively, therebetween. The bladder is mounted within the pump housing between upper and lower valves for controlling the flow of the drywall mastic material. The airway connects the air compressor, the control line, the bladder, and the air release mechanism, such that there is air flow communication therebetween. When the air release mechanism closes, the bladder inflates such that drywall mastic material in the pump housing is pumped through the upper valve, the material line, and the tool to the work surface. When the air release mechanism opens, the bladder deflates such that a partial vacuum is created within the pump and drywall mastic material in the container is pumped through the lower valve into the pump housing.

16 Claims, 29 Drawing Sheets

DRYWALL TAPING AND TEXTURE SYSTEM USING PUMP

RELATED APPLICATIONS

This application claims the benefit of U.S. Provisional Application 060/052,261 entitled "Mud Pump and Drywall Tape and Texture System," filed Jul. 11, 1997.

FIELD OF THE INVENTION

This invention relates to drywall taping and texture systems, and, in particular embodiments, to a drywall taping and texture system using a pump.

BACKGROUND OF THE INVENTION

Traditionally, in gypsum wallboard or "drywall" panel installation, sheets of drywall are nailed or screwed in place. Seams between the drywall sheets must be taped over, and the nail or screw heads must be coated with paper tape and mastic material to form a continuous wall surface. Tape and mastic material must also be applied to inside corners to form a complete wall system. The task of applying drywall tape and mastic drywall mud is generally laborious, tedious, and messy. Although inventions have made the task easier, improvement is still needed. One currently available drywall taping tool is the pedestrian mud pan and drywall knife.

With a mud pan and drywall knife, a workman manually applies drywall tape and mud. First, the workman removes a scoop of mud from a bulk container in a mud supply area and places it in the mud pan. This action is repeated until the pan is full. The workman then walks from the mud supply area to the seam that he wishes to tape. The workman then scoops a quantity of mud onto the knife, turns the knife blade towards the wall, and with a series of wiping motions, coats the seam with mud more or less uniformly. After precutting the seam, the workman lays paper tape over the seam and presses it into the mud to achieve tape attachment. He then glides the knife over the tape, forcing mud and air out from behind the tape, and begins to smooth the surface. A first coat of mud is applied to the drywall tape either at the time that the tape is applied or later, depending on the workman's technique.

After a period of drying, another coat of mud is applied to the tape and dressed with a drywall knife, thus covering the seam with a wider coat of mud. The same steps of walking to the mud supply area, scooping out mud until the pan is full, and then walking back to the work area are repeated.

After a second period of drying, most inexperienced workmen sand the seams before applying a final coat of mud. The final coat of mud requires further walking between the mud supply and the work areas and further scooping and filling of the mud pan as before.

Complicating the situation are inside corner seams. Most workmen find inside corner seams the hardest and most time consuming to tape and coat of any seam. There are special knives that have a ninety degree bend to help dress these difficult seams.

To overcome the drawbacks of manual drywall tape application and finishing tools such as the mud pan and drywall knife, a drywall taping system has been developed by Ames Tool Company (Ames), for example, that includes a manual, lever action, fluid mud pump that fills assorted mud applicator tools. A hand lever on the manual pump is pumped up and down to transfer drywall mud out of a bucket directly into a mud applicator tool. The mud is squirted into a slot in some tools and into other tools though a special fitting.

However, this system still requires walking between the mud supply and work areas, thus wasting time and energy. Only about ninety feet of tape can be applied with the Ames taper tool before a mud refilling is required, while each roll of paper tape is about 500 feet. Only about three to four vertical seams, where each seam is about eight feet long, can be filled with the Ames box tools before more mud is required. Thus, a day's work requires hundreds of trips between the mud supply and work areas for mud refills with the Ames drywall taping system.

Additionally, each of the tools in the Ames system takes some toll upon the user's energy. The Ames taper tool is powered by the user forcing a wheel to turn as it contacts the wall at the end of the tool. The Ames box tool requires the operator to forcefully wipe a box of mud on an extended handle. Each of the Ames tools mechanically disgorge drywall mud as the result of human labor. Many tasks in drywall taping are thus prone to repetitive stress injury.

Furthermore, Ames tools require both a reservoir that holds one shot of mud and a device to manually exude the mud on each tool. The Ames system is expensive, heavy, and manually actuated.

The stators tube pump is well known to the drywall industry. This pump has a hollow threaded internal rubber sleeve encompassing a threaded rod. As the rod is turned, fluid drywall material is forced to exit the pump. However, the stators pump requires an electric motor or gas engine to operate and is thus expensive to build. The stators pump is also very inefficient due to friction, so a large power source is required. Therefore, fluid material delivery systems using a stators pump for drywall work are expensive.

SUMMARY OF THE DISCLOSURE

It is an object of an embodiment of the present invention to provide an improved drywall taping and texture system using a pump, which obviates for practical purposes, the above mentioned limitations.

According to an embodiment of the present invention, a drywall taping and texture system for pumping drywall mastic material from a container filled with the drywall mastic material to a work surface includes a pump housing, an air compressor, a tool for applying the drywall mastic material to the work surface, material and control lines, an inflatable bladder, an air release mechanism, and an airway. The pump housing is immersed in the container filled with the drywall mastic material, and the air compressor is connected to the pump housing. The material and control lines are connected between the pump housing and the tool such that there is material and air flow communication, respectively, therebetween. The bladder is mounted within the pump housing between upper and lower valves for controlling the flow of the drywall mastic material. The airway connects the air compressor, the control line, the bladder, and the air release mechanism, such that there is air flow communication therebetween. When the air release mechanism closes, the bladder inflates such that drywall mastic material in the pump housing is pumped through the upper valve, the material line, and the tool to the work surface. When the air release mechanism opens, the bladder deflates such that drywall mastic material in the container is pumped through the lower valve into the pump housing.

In particular embodiments of the present invention, the tool further includes a button for remotely controlling the air release mechanism. In other embodiments of the present invention, each of the upper and lower valves for controlling the flow of the drywall mastic material includes a seat having an orifice through which the drywall mastic material flows and a member for controlling the flow of the drywall mastic material through the orifice. When the member mates with the seat, a seal is formed to block the flow of the drywall mastic material through the orifice. When the member moves in a direction transverse to the seat, flow of the drywall mastic material through the orifice is allowed. In yet other embodiments of the present invention, the pump housing further includes a screen mounted at the bottom thereof for filtering particles out of the drywall mastic material.

A set of drywall mud, tape, and texture application and finishing tools may be attached to and used with the drywall taping and texture system. Such tools include: a tape applicator tool and pneumatic tape cutter attachment for applying muddy drywall tape; a wand tool and a corner tool attachment for placing a bead of mud upon a seam; a mud knife tool for dispensing and dressing coats of mud; a metering mud bead tool; a wall texture spray tool; and an acoustic texture spray tool. A set of adapter parts that allow use of the pump with Ames tools may also be attached to and used with the pump.

In another embodiment of the present invention, a drywall taping and texture system for pumping drywall mastic material from a container filled with the drywall mastic material to a work surface includes a pump housing, a tool for applying the drywall mastic material to the work surface, material and control lines, an inflatable bladder, an inflation sensor, and an air compressor. The pump housing is immersed in the container filled with the drywall mastic material. The material and control lines are connected between the pump housing and the tool such that there is material and air flow communication, respectively, therebetween. The bladder is mounted within the pump housing between upper and lower valves for controlling the flow of the drywall mastic material. The inflation sensor is coupled to the bladder for determining when the bladder is inflated and when the bladder is deflated. The air compressor is mounted within the pump housing and connected to the control line and the bladder such that there is flow communication therebetween. When the inflation sensor determines that the bladder is deflated, the air compressor is activated and the bladder inflates such that drywall mastic material in the pump housing is pumped through the upper valve, the material line, and the tool to the work surface. When the inflation sensor determines that the bladder is inflated, the air compressor is deactivated and the bladder deflates such that drywall mastic material in the container flows through the lower valve into the pump housing.

In another embodiment of the present invention, an apparatus for pumping a fluid includes a housing, an inflatable bladder, and a means for inflating and deflating the bladder. The bladder is mounted within the housing between upper and lower valves for controlling the flow of the fluid. When the bladder is inflated, the fluid in the housing is pumped through the upper valve and out of the apparatus. When the bladder deflates, the fluid is pumped through the lower valve into the housing.

In particular embodiments of the present invention, the means for inflating and deflating the bladder is an air compressor connected to the housing and the bladder. In other embodiments of the present invention, each of the upper and lower valves for controlling the flow of the fluid include a seat having an orifice through which the fluid flows and a member for controlling the flow of the fluid through the orifice. When the member mates with the seat, a seal is formed to block the flow of the fluid through the orifice. When the member moves in a direction transverse to the seat, flow of the fluid through the orifice is allowed. In yet other embodiments of the present invention, the seat further includes a raised ring for mating with the member. In still other embodiments of the present invention, the housing further includes a screen mounted at the bottom thereof for filtering particles out of the fluid.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

FIG. 4*a* shows the pump during intake of drywall material, and FIG. 4*b* shows the pump during exhaust of drywall material.

FIG. 6*a* is a cross-sectional view of a seat in accordance with an embodiment of the present invention. FIG. 6*b* is a perspective view of the seat, and FIG. 6*c* is a top plan view of the seat. FIG. 6*d* is a cross-sectional view of a ball in accordance with an embodiment of the present invention.

FIGS. 8*a* and 8*b* are perspective views of a button with a hole. FIGS. 8*c* and 8*d* are perspective views and FIG. 8*e* is a perspective view of pressure relief valve.

FIG. 9*a* is a partial cross-sectional view of the interior of the pump. FIG. 9*b* is an exploded perspective view of a solenoid module for controlling the electrical version of the pump. FIG. 9*c* is an exploded, partial cross-sectional view of an inflation sensor for electronically sensing the condition of the bladder.

FIGS. 11*a* and 11*b* are partial cross-sectional views of the pneumatic tape cutter. FIG. 11*c* is a cross-sectional view of the pneumatic tape cutter.

FIG. 12*a* is a perspective view of the wand tool, and FIG. 12*b* is a partial cross-sectional view of the wand tool.

FIG. 18*a* shows perspective and top plan views of an Ames adapter button. FIG. 18*b* is a perspective view of an Ames adapter gooseneck. FIG. 18*c* shows perspective and top plan views of an Ames adapter box filler.

FIGS. 19*a* and 19*b* are cross-sectional views of the universal tool fitting part, FIG. 19*c* is a perspective view of the universal tool fitting part, and FIGS. 19*d* and 19*e* are cross-sectional views of components of the universal tool fitting part.

DETAILED DESCRIPTION OF THE PREFERRED EMBODIMENTS

Figure 1:
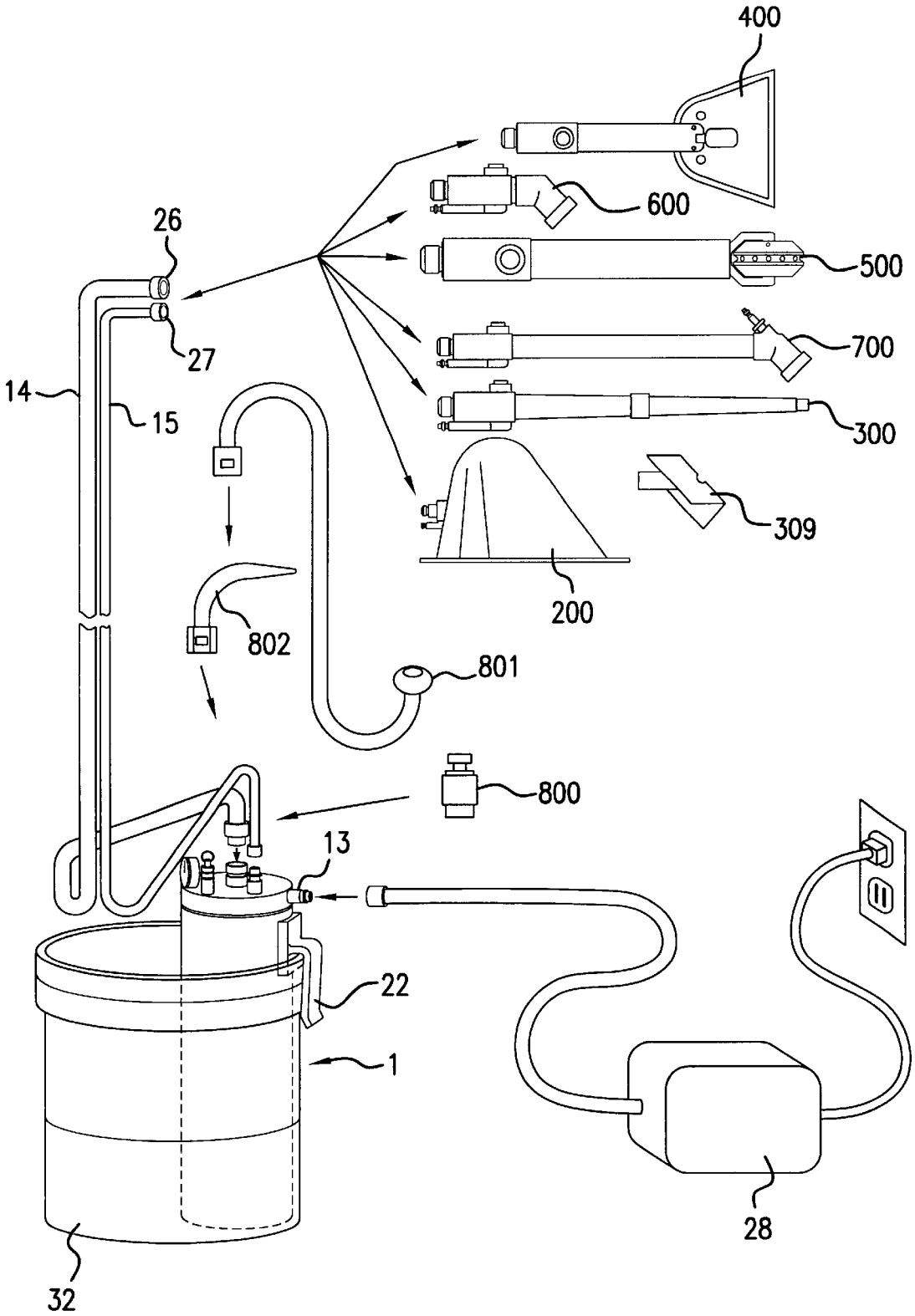
FIG. 1 is a perspective view of a drywall taping and texture system using a pump in accordance with an embodiment of the present invention.

As shown in the drawings for purposes of illustration, the invention is embodied in a drywall taping and texture system and a pump. In preferred embodiments of the present invention, the drywall taping and texture system utilizes the pump and various tools connected to the pump for applying drywall tape, as well as mastic or fluid drywall mud and texture, to wall surfaces. However, it will be recognized that the pump may be used in other systems and with other fluids, such as oil, gas, or the like.

Figure 2:
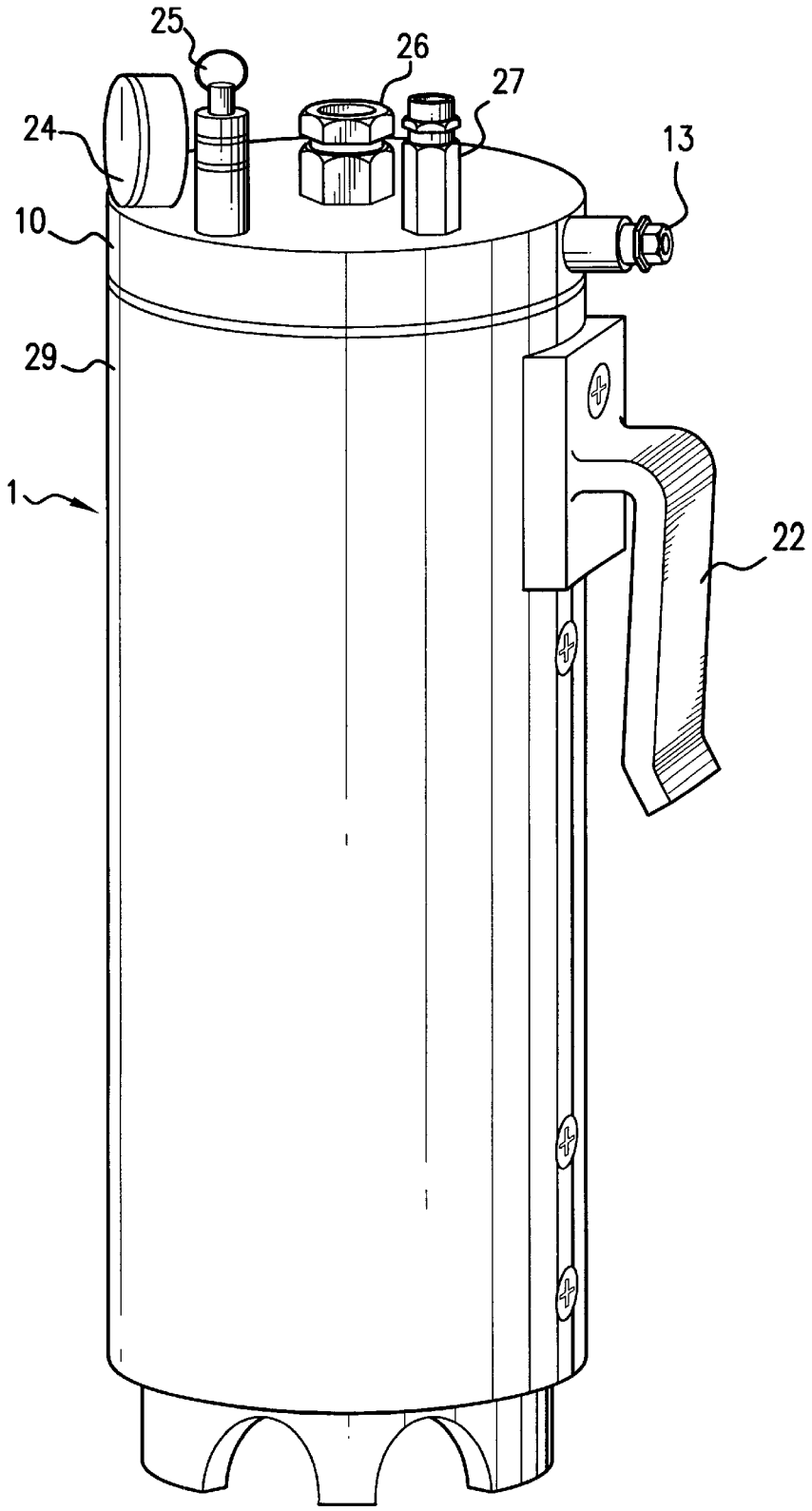
FIG. 2 is a perspective view of the exterior of the pump shown in FIG. 1.

FIG. 1 shows a perspective view of a drywall taping and texture system using a pump in accordance with an embodiment of the present invention. The drywall taping and texture system includes a pump 1 immersed in a container of mastic or fluid drywall material 32. The pump 1 is supported in the container by a clip 22. Referring to FIGS. 1 and 2, the pump 1 is formed from a generally cylindrical housing 29. The housing 29 is a solid shell with strength to withstand changes in pressure within the pump 1 and to support various parts of the pump 1. The housing 29 may be manufactured from simple drain pipe, which is cut to an appropriate length and then drilled to hold fasteners, such as screws or the like, that penetrate into various parts of the pump 1. The pump 1 has a cap 10, which is attached to the housing 29 using fasteners, such as screws, nails, bolts, or the like. The pump cap 10 has an air stem fitting 13 for connecting to an air compressor 28. The pump cap 10 also has a material line fitting 26 and a control line fitting 27 for connecting a preferably plastic material line or hose 14 and a preferably plastic control line or hose 15, respectively, to the pump 1. The material line 14 and the control line 15 attach at their respective distal ends through another material line fitting 26 and another control line fitting 27, respectively, to a variety of tools, such as a tape applicator tool 200, a wand tool 300, a mud knife tool 400, a mud bead tool 500, a wall texture spray tool 600, and an acoustic texture spray tool 700. The pump 1 can also be attached to a variety of tools manufactured by Ames Tool Company through adapter parts 800, 801, and 802.

In the embodiment illustrated in FIGS. 1 and 2, the pump 1 has an air gauge 24 and a pressure relief valve 25. The pressure relief valve 25 is one type of air release valve or mechanism for releasing air from the drywall taping and texture system, as will be discussed below. In alternative embodiments, the air gauge 24 and the pressure relief valve 25 may be omitted.

Figure 3A:
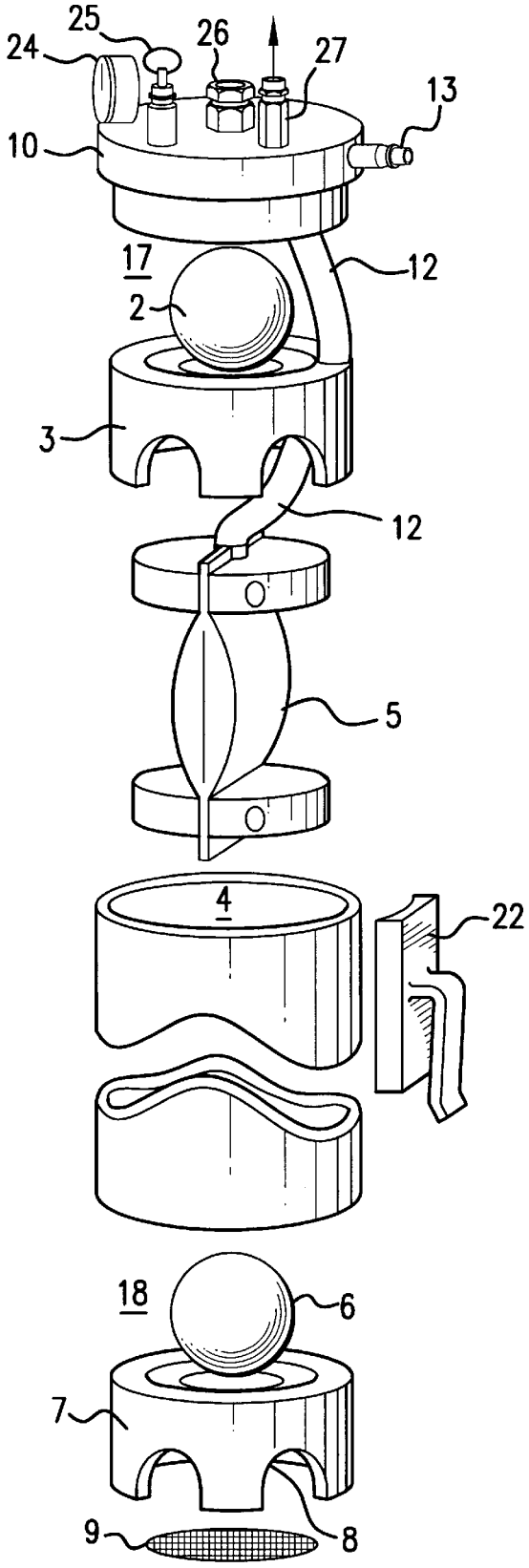
FIG. 3*a* is a perspective view of the interior parts of the pump shown in FIG. 1.
Figure 3B:
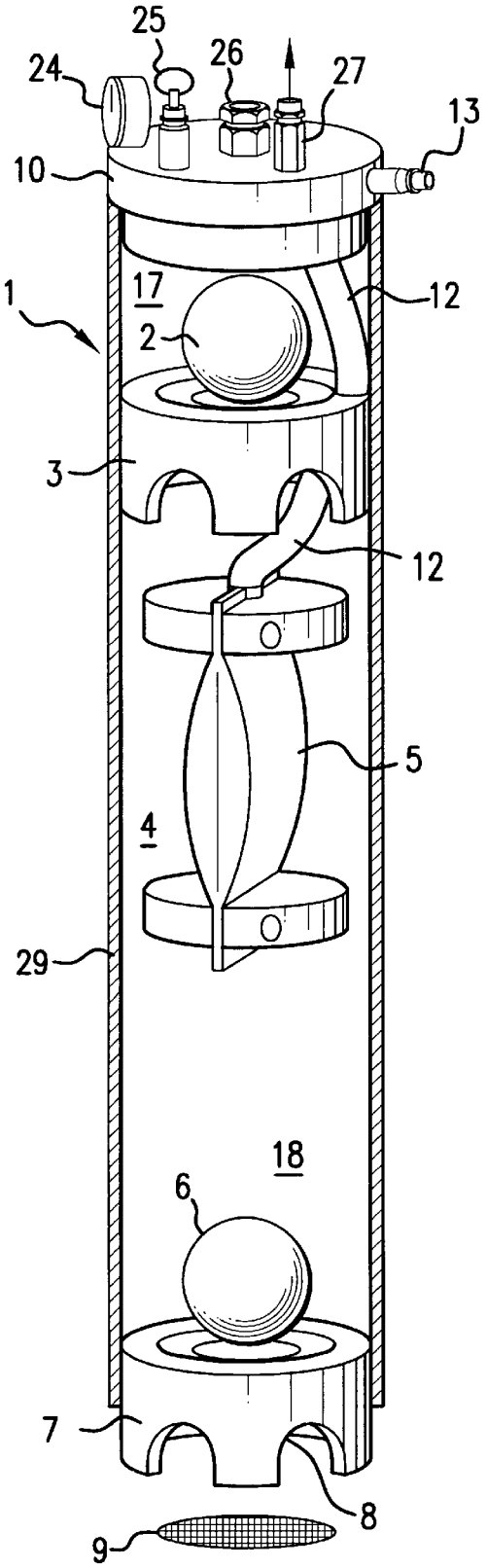
FIG. 3*b* is a partial cross-sectional view of the interior of the pump shown in FIG. 1.

As shown in FIGS. 3*a* and 3*b*, the bottom of the pump 1 has an intake orifice 8 covered with a screen 9. The screen 9 is a barrier to particulate matter that might ruin the drywall finish or plug the tool attached to the pump 10. The mesh size of the screen 9 is large enough to allow passage of acoustic ceiling grains, but small enough to stop larger particles. An user may change the screen 9 to screen mud or to spray acoustic. The screen 9 is positioned over the intake orifice 8 so that all drywall material 32 passes through the screen 9 prior to entering the pump 1.

In preferred embodiments, the pump 1 has upper and lower valves for controlling the flow of the drywall material 32. In preferred embodiments, the valves are check valves that create a one-way flow of the drywall material 32 upward through the pump 1. In the embodiment illustrated in FIGS. 3*a*–4*b*, each valve includes a seat 3 or 7 having a orifice 8 through which the drywall material 32 flows and a member 2 or 6 for controlling the flow of the drywall material 32 through the orifice 8. However, in alternative embodiments, the valves may include other components, such as flappers or the like. The lower valve is formed from a lower seat 7 and a lower member or ball 6. The upper valve is formed from an upper seat 3 and an upper member or ball 2.

Referring to FIGS. 3*a*–4*b* and 6*a*–6*d*, the upper and lower seats 3 and 7 are generally shaped as a band or ring and are configured to fit with the upper and lower balls 2 and 6, respectively. The seats 3 and 7 are secured to the housing 29 using fasteners, such as screws, nails, bolts, or the like. Drywall material 32 flows through an orifice 8 at about the center of the seat 3 or 7. In the illustrated embodiment, the seat 3 or 7 has a raised ring that contacts the ball 2 or 6, respectively, to separate granular elements from the drywall material 32 for proper sealing of the seat 3 or 7 and the ball 2 or 6, respectively. In alternative embodiments, the seat 3 or 7 may have other shapes. In further alternative embodiments, the raised ring may be omitted.

In the illustrated embodiment, the lower seat 7 holds the screen 9. The intake orifice 8 in the lower seat 7 has lateral vents so that the pump 1 will not be closed off by contact with the bottom of the container of drywall material 32.

The upper and lower balls 2 and 6 are generally similar. The ball 2 or 6 is preferably made from a heavyweight material, such as iron, lead, or the like, and is covered with a soft rubber or rubber-like material, such as elastomeric material or the like. The rubber or rubber-like material helps the ball 2 or 6 to seal with the seat 3 or 7 when stopping the backwards flow of the drywall material 32. By way of example, the ball 2 or 6 may be a solid material ball with a rubber coating, a rubber ball with a lead shot filling, or a spring-loaded ball. The ball 2 or 6 plugs the seat 3 or 7, respectively, when the drywall material 32 flows backwards, but does not stick in the orifice 8 of the seat 3 or 7. The upper and lower valves thus create a one-way flow of the drywall material 32 upward through the pump 1.

The pump 1 has a bladder 5 mounted within the housing 29 between the upper and lower valves. Referring to FIGS. 3*a*–4*b* and 7, the bladder 5 is made from a resilient, rubber or rubber-like material, such as elastomeric material or the like, and has a diameter smaller than the diameter of a material chamber 4 of the pump 1. When inflated, the bladder 5 could be larger than the material chamber 4, but is restrained by the cylinder body pump housing 29. The pump housing 29 allows drywall material 32 to flow around the bladder 5, but restrains the bladder 5 when it reaches the maximum allowable size of the interior of the housing 29. The rubber-like material of the bladder 5 has a plastic memory and will resiliently seek to return to its "normal size" (uninflated).

The bladder 5 may be inexpensively built and easily replaced using two pairs of clip parts 11 that clamp a rubber cylinder between them. An air line or hose 12 may also be connected to the bladder 5 and clamped between the clip parts 11. The clip parts 11 may be large enough to keep the lower ball 6 from becoming fouled in the bladder 5.

As shown in FIGS. 3*a*–5*a*, an airway in the cap 10 connects the optional pressure relief valve 25, the control line fitting 27 that is in turn connected to the control line 15, the air stem fitting 13 that is in turn connected to the air compressor 28, and the bladder 5 via the air stem 12. Air flow communication is thus established among these parts.

Each tool has a control mechanism, such as a button, that allows the user to remotely control the pump 1, via the control line 15. In particular, the user utilizes the mechanism to deliver drywall material 32 to the work surface as needed and to control an air release valve or mechanism directly connected to the tool or remotely located on the pump 1. FIGS. 8*a*–8*e* illustrate several types of such air release mechanisms.

Figure 8A:
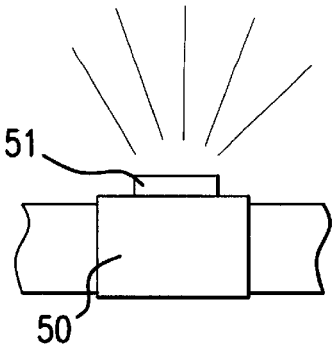
FIGS. 8*a*–8*e* are perspective views of several types of air release valves or mechanisms remotely controlled by various tools in accordance with an embodiment of the present invention.
Figure 8B:
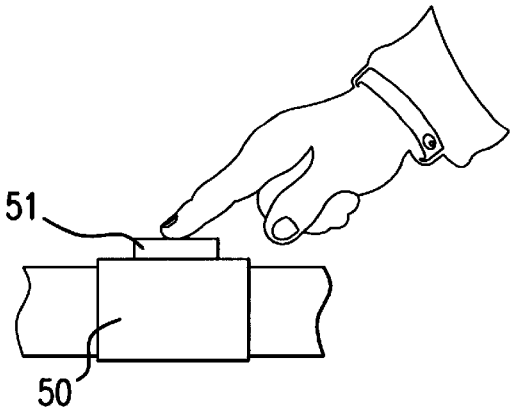

As illustrated in FIGS. 8*a* and 8*b*, the air release mechanism is a button 50 with an air release hole 51 at about the center of the button 50. The user opens and closes the air release mechanism by alternatively uncovering and covering the hole 51. This type of air release mechanism is directly connected to the tool.

Figure 8C:
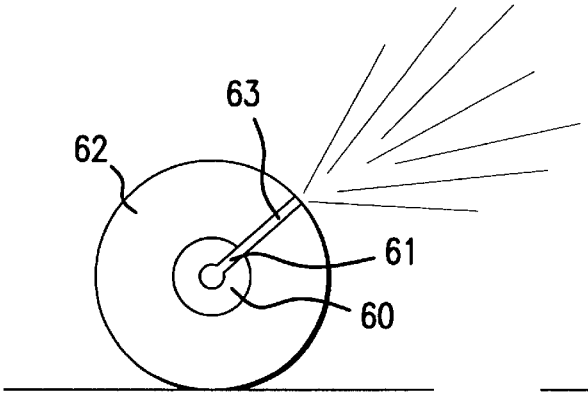
Figure 8D:
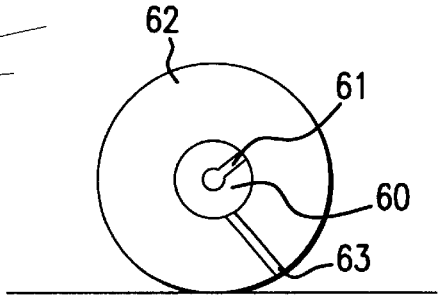
Figure 8E:
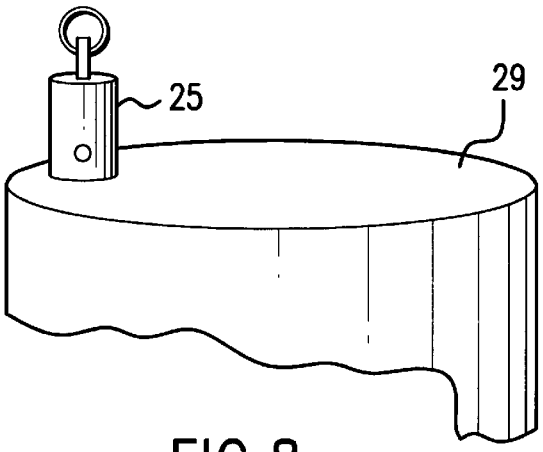

Referring to FIGS. 8*c* through 8*e*, the air release mechanism includes a hollow axle 60 with a radial hole 61 and a wheel 62 with a radial hole 63. As the wheel 62 is rolled along the work surface, the wheel 62 rotates around the axle 60. When the radial hole 61 in the axle 60 is aligned with the radial hole 63 in the wheel 62, the air release mechanism temporarily opens and air is released through the radial hole 63 in the wheel 62. Otherwise, when the radial hole 61 in the axle 60 is not aligned with the radial hole 63 in the wheel 62, the air release mechanism is closed. This type of air release mechanism is also directly connected to the tool. On such a tool, drywall material 32 flows to the work surface through another radial hole 64 in the axle 60 and one or more radial holes 65 in the wheel 62. When the radial hole 64 in the axle 60 is aligned with one of the radial holes 65 in the wheel 62, drywall material 32 flows out of the tool and onto the work surface.

Figure 4A:
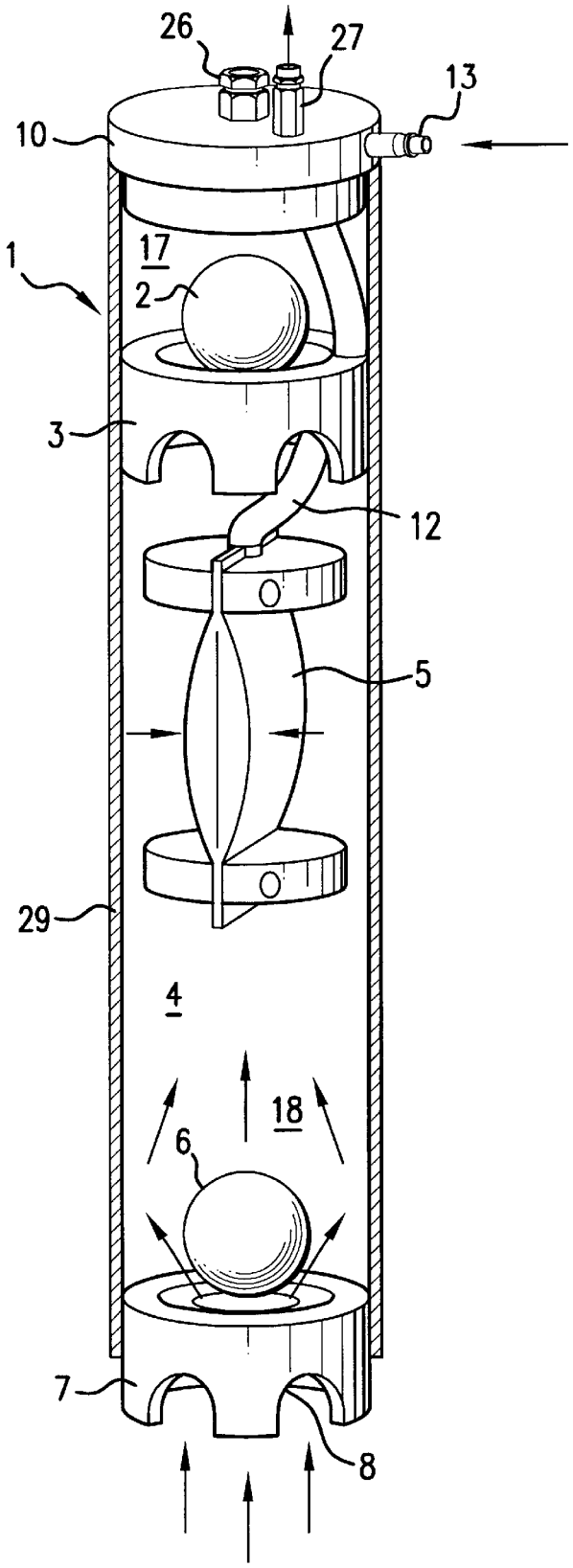
FIGS. 4*a* and 4*b* are partial cross-sectional views of the interior of the pump illustrating the pump in action.
Figure 4B:
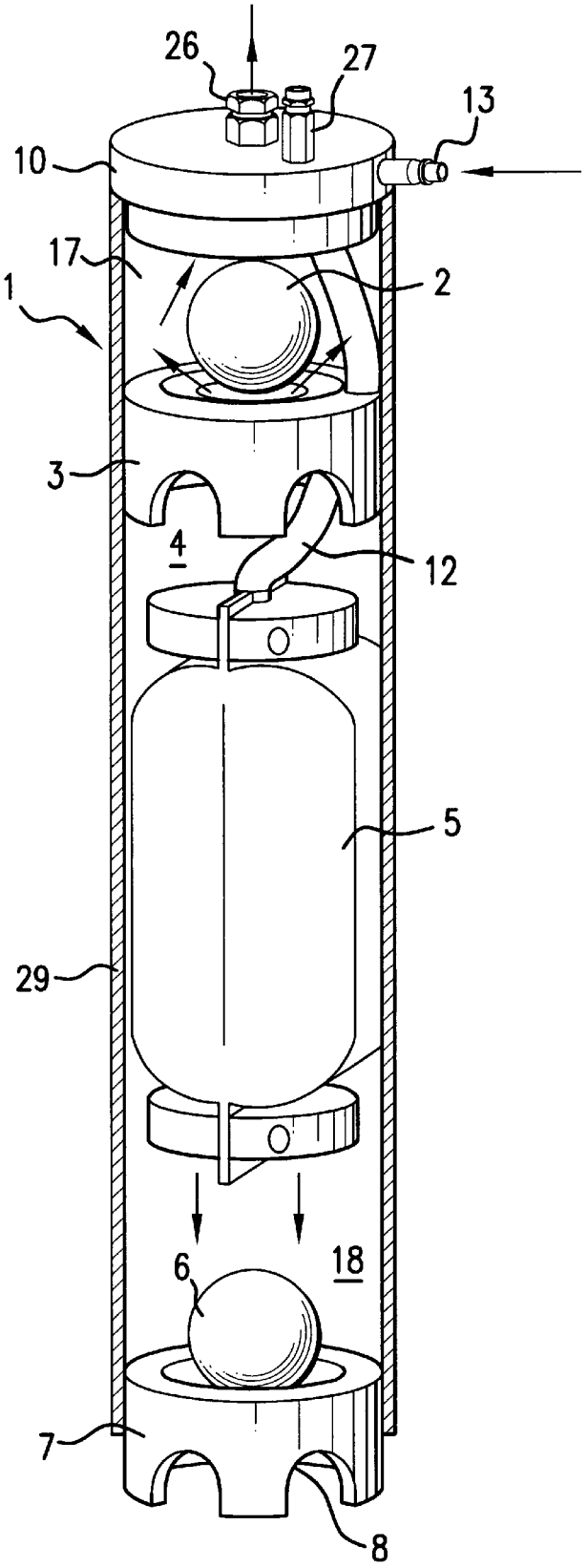
Figure 5A:
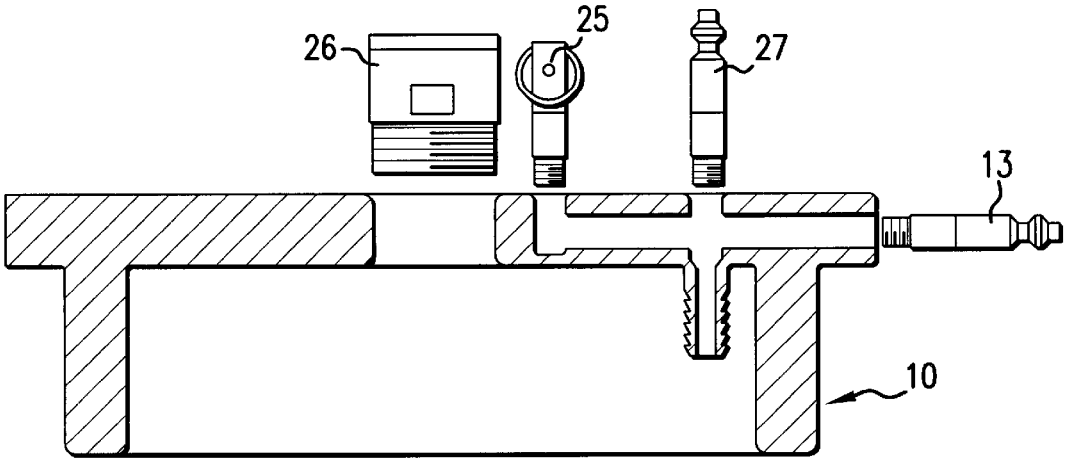
FIG. 5*a* is a side, cross-sectional view of a pump cap in accordance with an embodiment of the present invention.
Figure 5B:
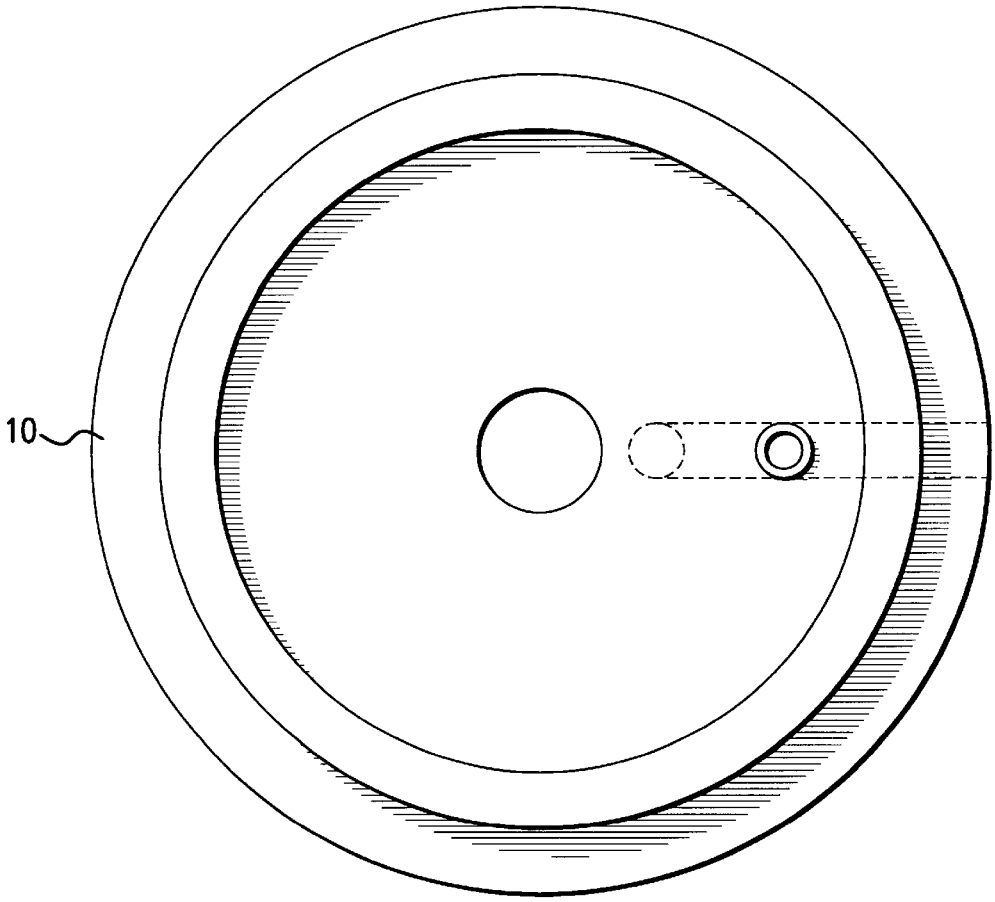
FIG. 5*b* is a top plan view of the pump cap.
Figure 5C:
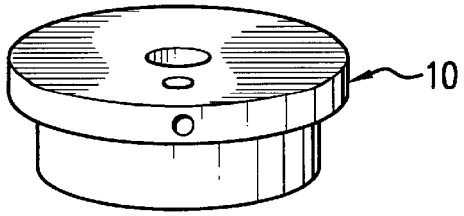
FIG. 5*c* is a perspective view of the pump cap.
Figure 6A:
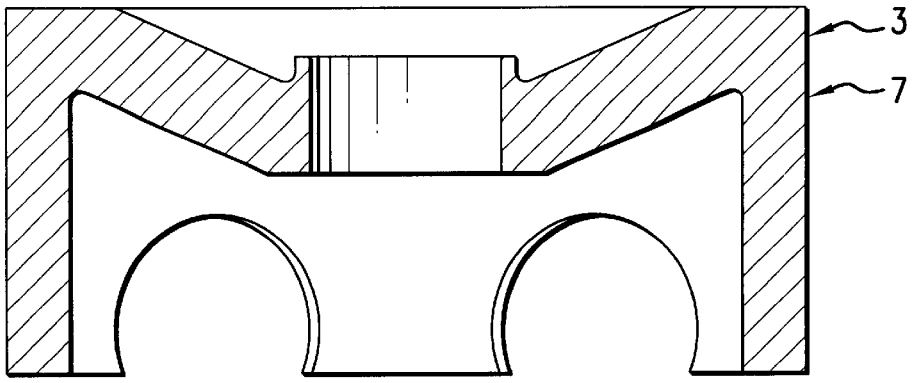
FIGS. 6*a*–6*d* are views of seat and ball components of a valve in accordance with an embodiment of the present invention.
Figure 6B:
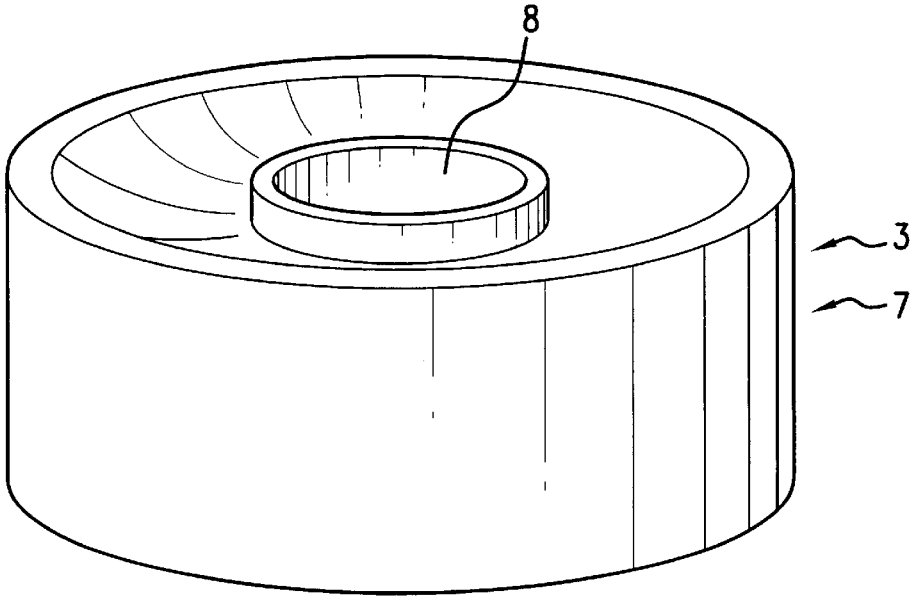
Figure 6C:
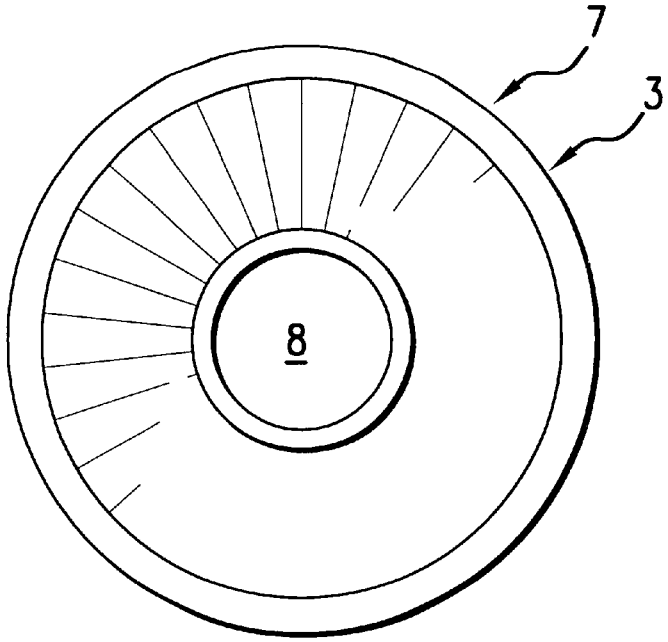
Figure 6D:
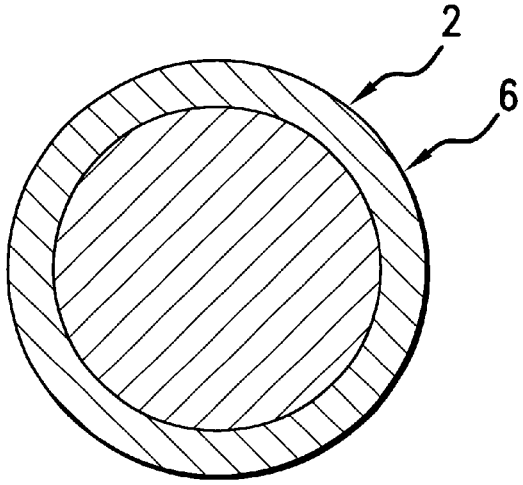
Figure 7:
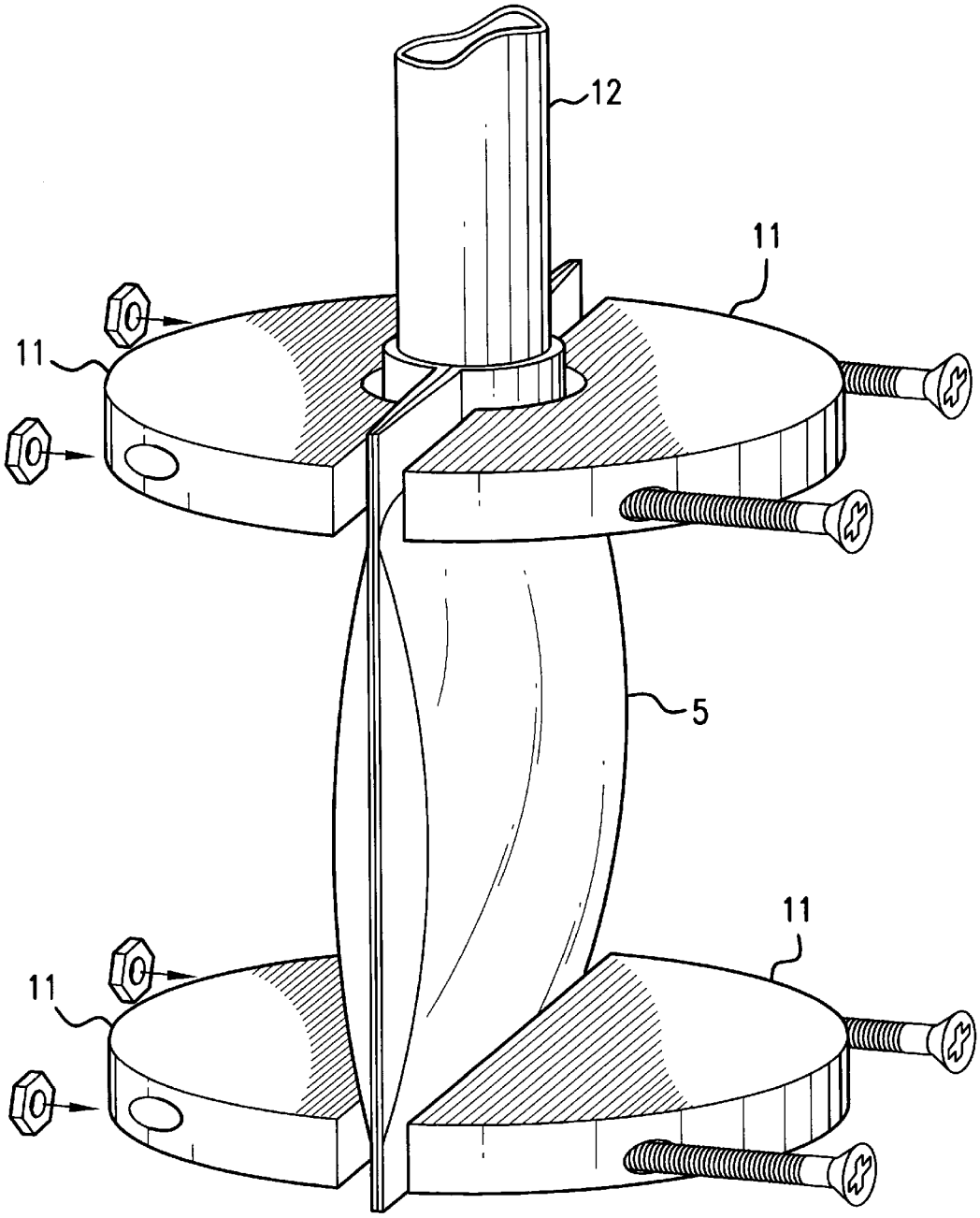
FIG. 7 is a perspective view of bladder clips and a bladder in accordance with an embodiment of the present invention.

Referring to FIGS. 4*a* and 4*b*, when the pump 1 is placed in the container filled with mastic or fluid drywall material 32, drywall material 32 wants to flow into the pump 1 due to gravity. The lower ball 6 is lifted out of the lower seat 7 due to greater pressure outside the pump 1 and lower pressure inside the pump 1. Resistance to the flow of the drywall material 32 from the container into the pump 1 is minor because the lower valve resists flow in the opposite direction. Once the pump 1 is filled with drywall material 32, the bladder 5 is inflated, resulting in positive pressure within the pump 1. This pressure closes the lower valve and also lifts the upper ball 2 out of the upper seat 3, thus forcing drywall material 32 through the material line 14 and the attached tool, and onto the work surface.

Each tool has a button for remotely controlling the pump 1 via the control line 15. When the user presses the button, the release of air at the tool or at the pump 1 is stopped. Pressure builds up in the control line 15 and causes the bladder 5 to inflate, thus forcing drywall material 32 through the upper valve and out of the pump 1, through the material line 14 and the tool, and onto the work surface. After a surge of a certain volume of drywall material 32, the user reduces the air pressure by releasing air at the tool or at the pump 1. The bladder 5 quickly deflates and reduces the volume of the bladder within the pump 1. The resulting partial vacuum formed by the shrinking bladder 5 refills the material chamber 4 of the pump 1 with drywall material 32 through the lower valve. Subsequent inflation of the bladder 5 forces drywall material 32 through the upper valve because space within the material chamber 4 is reduced as the bladder 5 inflates. A surge of drywall material 32 is thus created, which flows out of the pump 1, through the material hose 14 and attached tool, and onto the work surface. When a more continuous flow of drywall material 32 is needed, the user simply needs to continuously hold down the remote control button on the tool, which causes the pressure within the bladder 5 to rise to a preset maximum level.

Figure 9A:
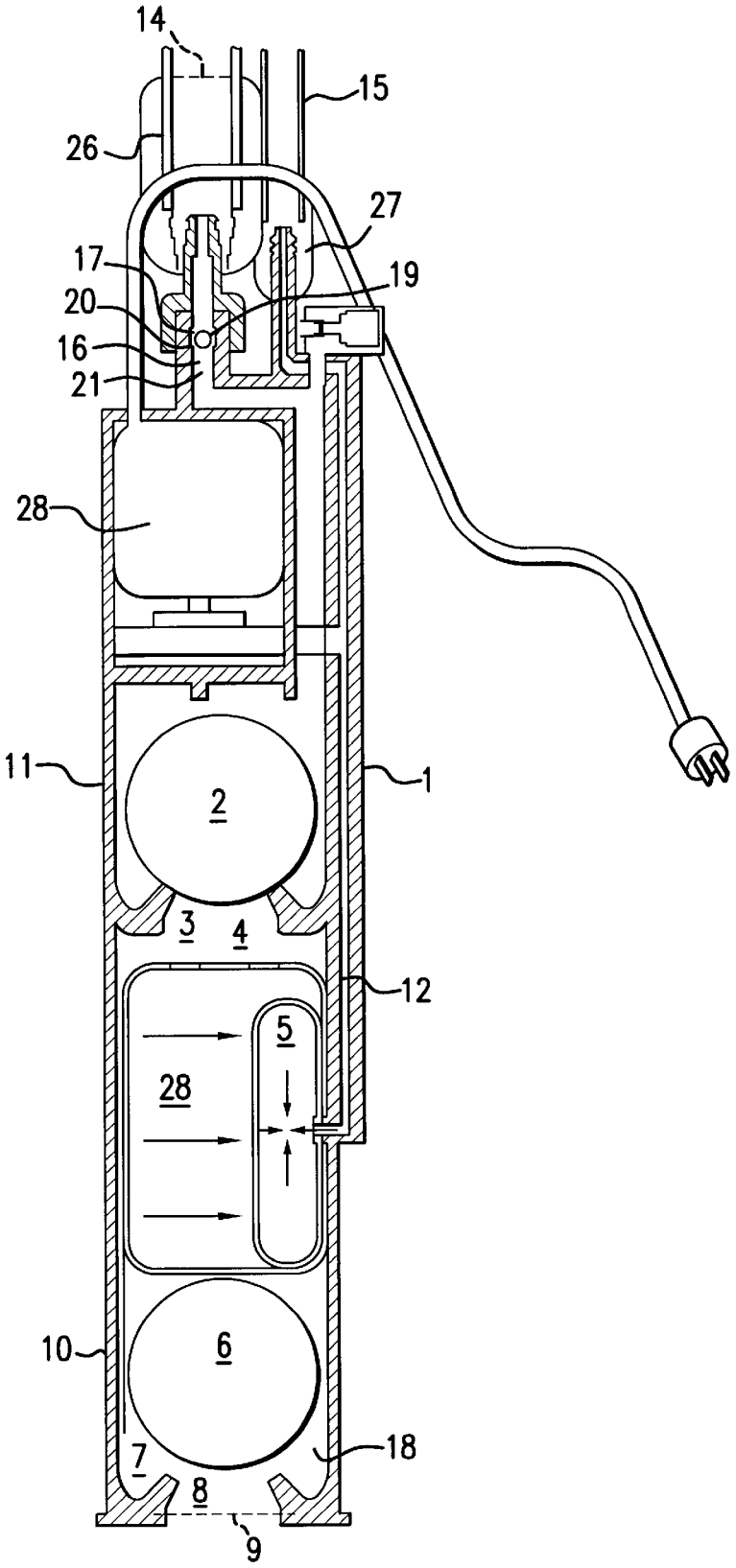
FIGS. 9*a*–9*c* are views of an electrical version of the pump in accordance with an alternative embodiment of the present invention.
Figure 9B:
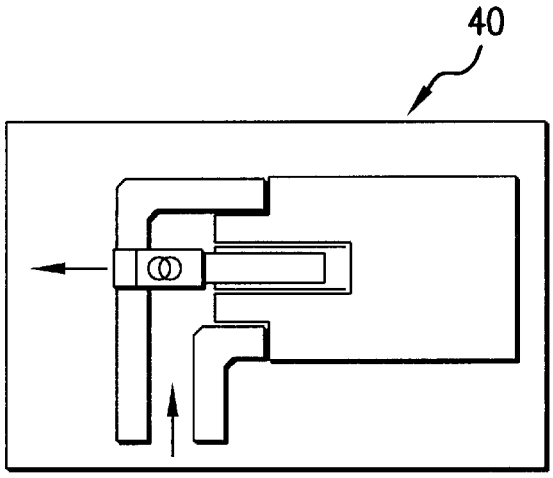
Figure 9C:
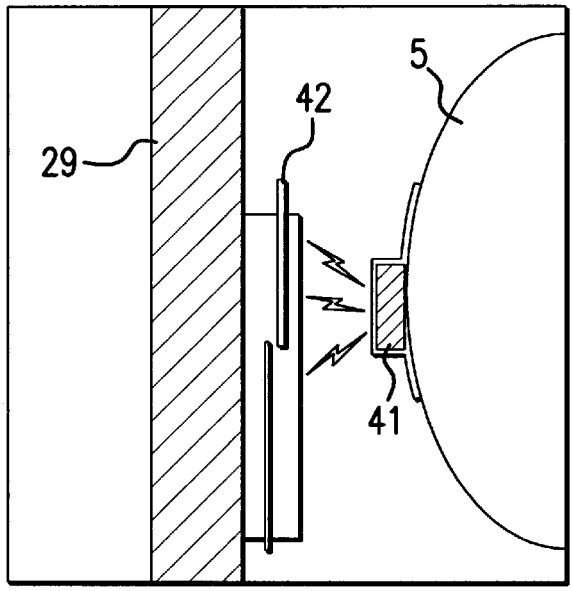

FIGS. 9*a*–9*c* illustrate an electrical version of the pump 1 in accordance with an alternative embodiment of the present invention. The air compressor 28 is mounted within the pump housing 29 and is connected to the bladder 5. An inflation sensor, which includes a magnet 41 attached to the bladder 5 and a reed switch 42 attached to the housing 29, determines the inflation state of the bladder 5. When the inflation sensor determines that the bladder 5 is deflated, the air compressor 28 is turned on to inflate the bladder 5. When the inflation sensor determines that the bladder 5 is inflated, the air compressor 28 is turned off. The air compressor 28 may be pneumatically controlled with a solenoid module 40 or electrically controlled.

As shown in FIG. 9*a*, the pump 1 has a secondary exhaust valve at a material exhaust orifice 16, which is connected to the material line fitting 26 and the material line 14. The secondary exhaust valve includes a secondary check ball 19, seat 20, and chamber 21, which support the material line fitting 26. This secondary valve is optional and is only required for some fluid materials.

The set of tools that may be used with the pump 1 includes drywall mud, tape, and texture application and finishing devices. Each tool connects to the material line 14 and the control line 15. Referring to FIGS. 19*a*–19*e*, an universal tool fitting part 900 is provided for use with the tools. This part 900 allows for convenient mass production of the drywall taping and texture system. The universal fitting part 900 is preferably made using an injection molding process. The universal fitting part 900 forms the handle, the material line fitting 901, the control line fitting 902, and the control button 903 on the wand tool 300, the mud knife tool 400, the mud bead tool 500, the wall texture spray tool 600, and the acoustic texture spray tool 700.

Figure 20A:
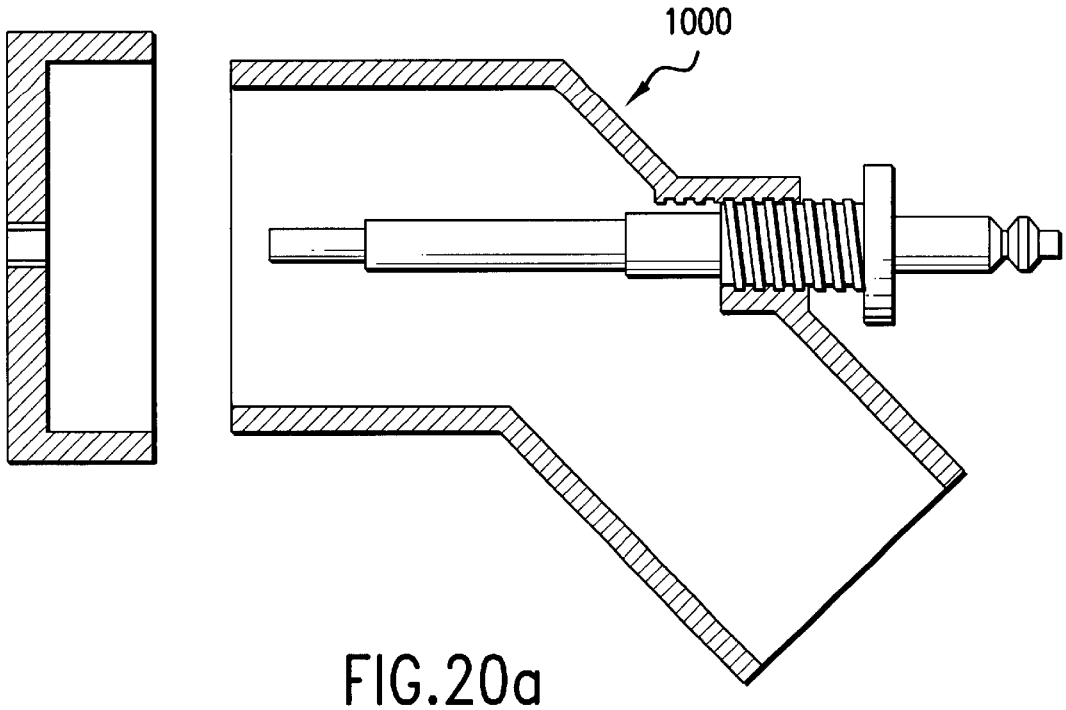
FIGS. 20*a*–20*c* are partial cross-sectional views of an universal spray head part in accordance with an embodiment of the present invention.
Figure 20B:
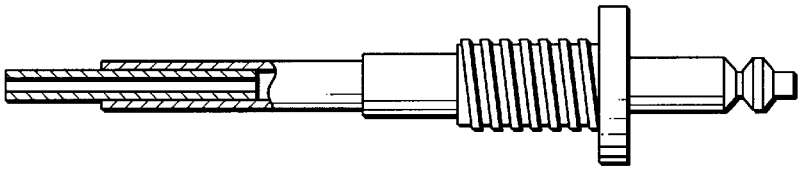
Figure 20C:
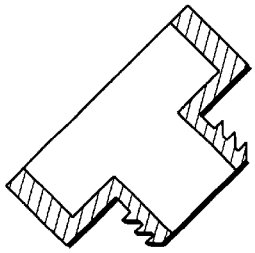

Referring to FIGS. 20*a*–20*c*, an universal spray head part 1000 is used with the two spray tools, the wall texture spray tool 600 and the acoustic texture spray tool 700. The universal spray head part 1000, in conjunction with an universal tool fitting part 900 and a short section of PVC pipe, produces the wall texture spray tool 600. The universal spray head part 1000, in conjunction with an universal tool fitting part 900 and a longer section of PVC pipe, produces the acoustic texture spray tool 700.

Figure 10A:
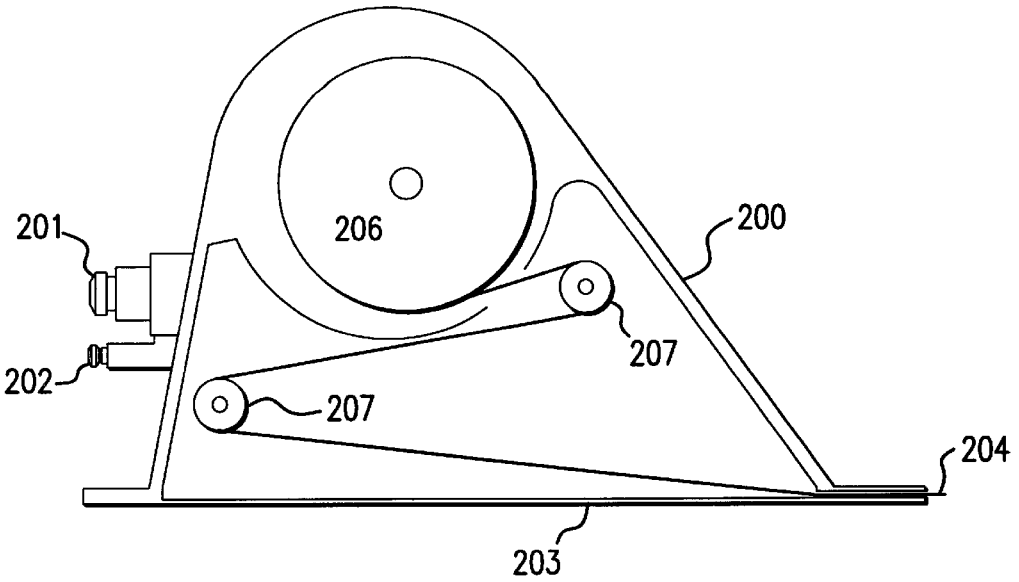
FIGS. 10*a* and 10*b* are front and back perspective views of a tape applicator tool in accordance with an embodiment of the present invention.
Figure 10B:
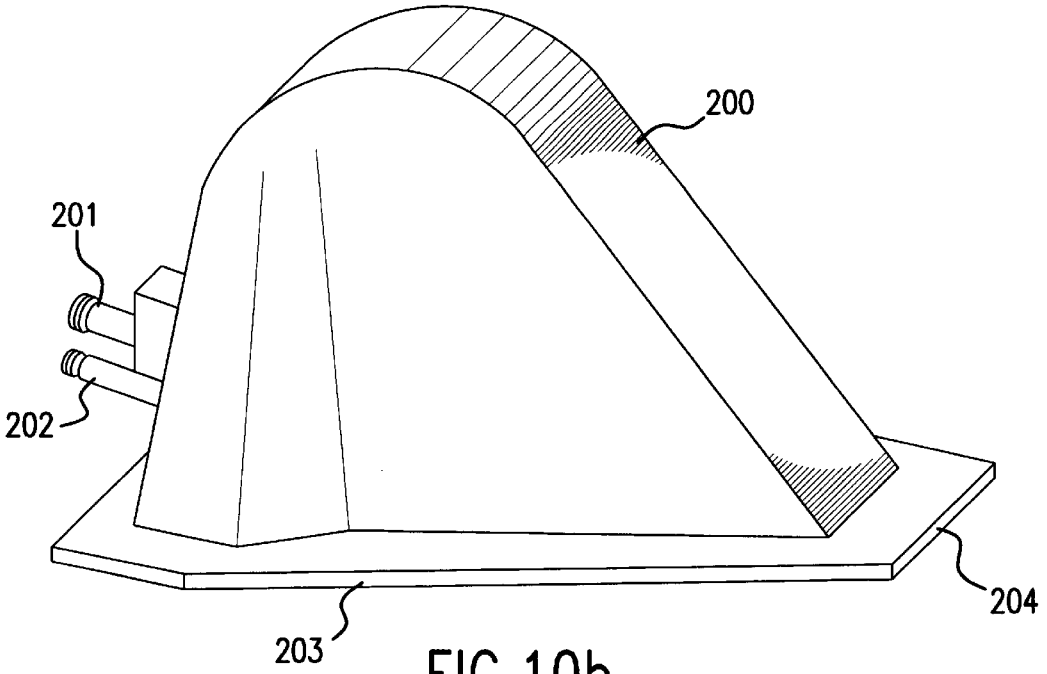
Figure 11A:
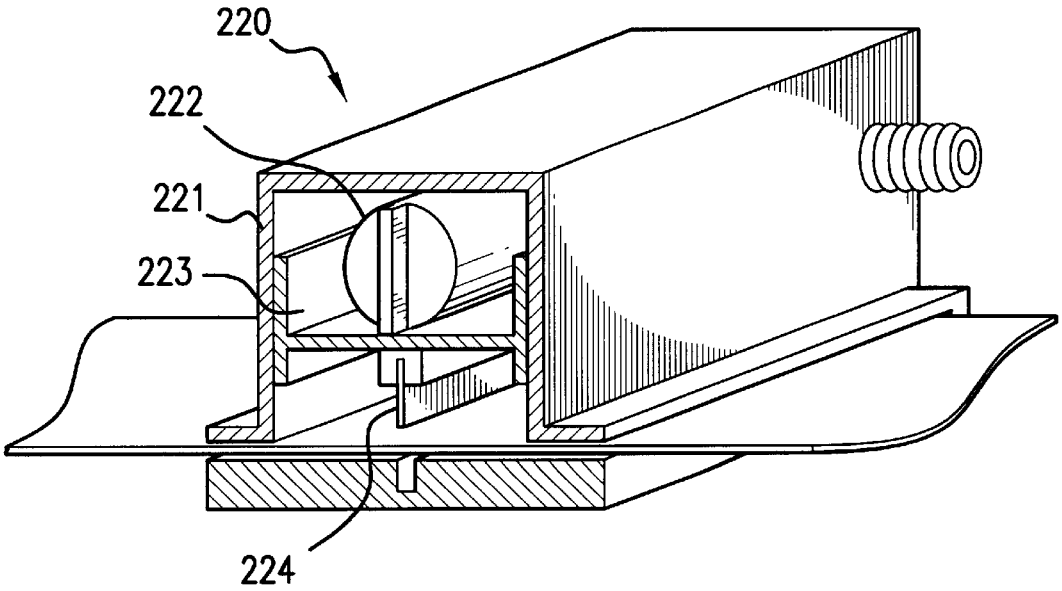
FIGS. 11*a*–11*c* are views of a pneumatic tape cutter in accordance with an embodiment of the present invention.
Figure 11B:
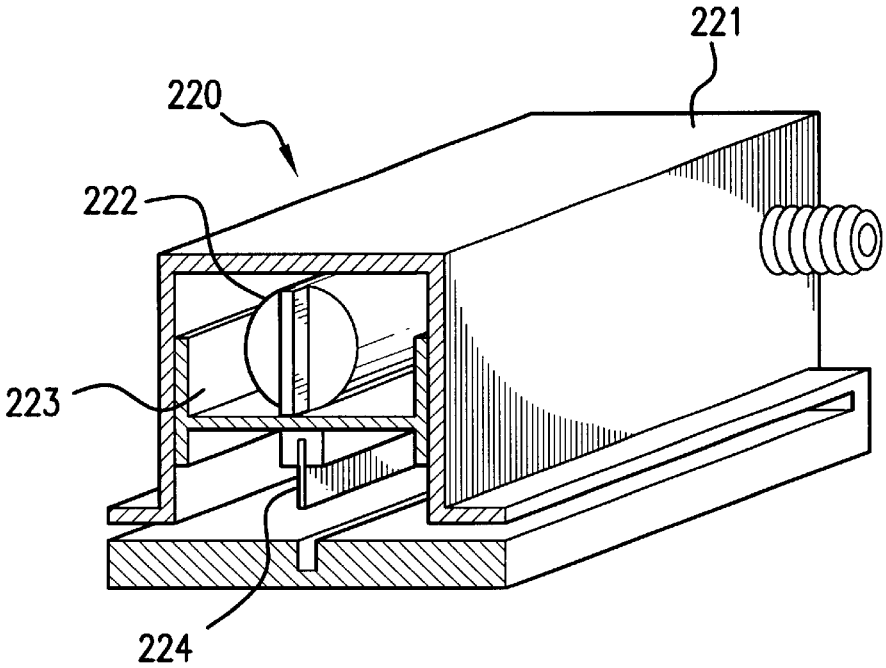
Figure 11C:
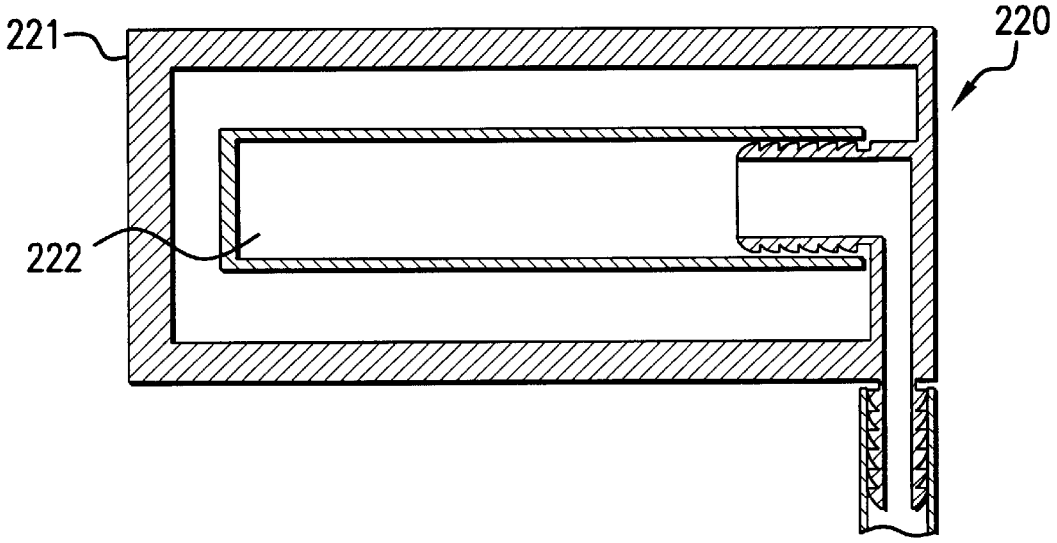

As shown in FIGS. 10*a* and 10*b*, the tape applicator tool 200 is used to hold, cut, and apply drywall tape and mud. The tool 200 connects to the material line 14 and control line 15 via fittings 201 and 202. The tape applicator tool 200 has a cavity that holds a supply of drywall tape 206 and an area to advance and cut off the tape 204. The tool 200 also has a material line that feeds the drywall material 32 into a wetting chamber as it flows out of the tool 200 onto the work surface. The tool 200 further has a base plate 203 to enclose the tool and a set of tape rollers 207. The tape applicator tool 200 may have a metering wheel to retrieve drywall material 32 from the pump 1 according to the distance that the tool 200 is moved along the work surface. As illustrated in FIGS. 11*a* through 11*c*, a pneumatic tape cutter 220 may also be added to the tape applicator tool 200 for cutting the drywall tape 206.

Figure 12A:
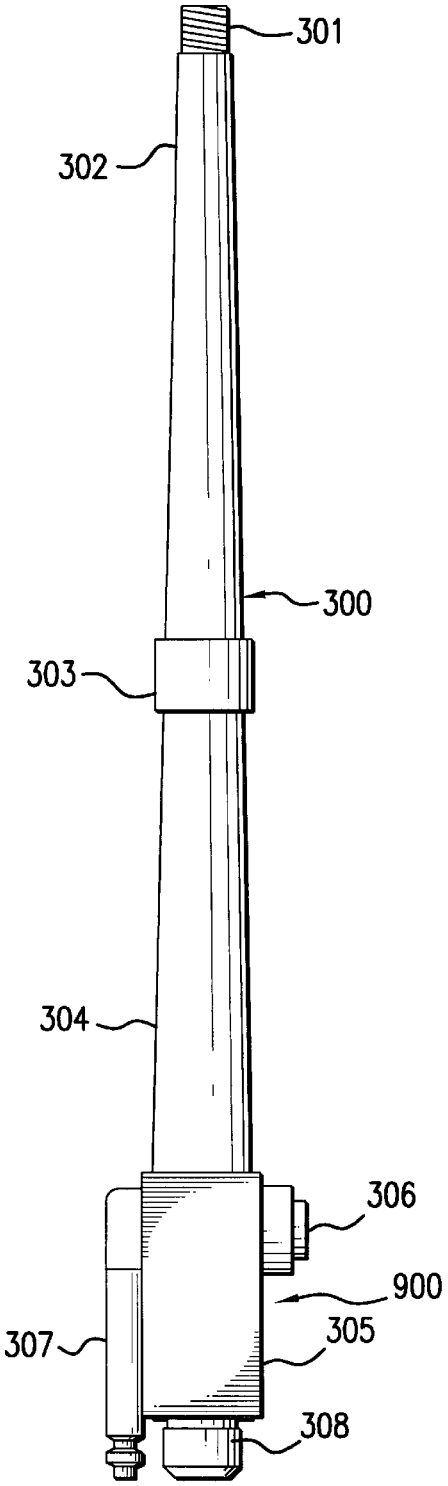
FIGS. 12*a* and 12*b* are views of a wand tool in accordance with an embodiment of the present invention.
Figure 12B:
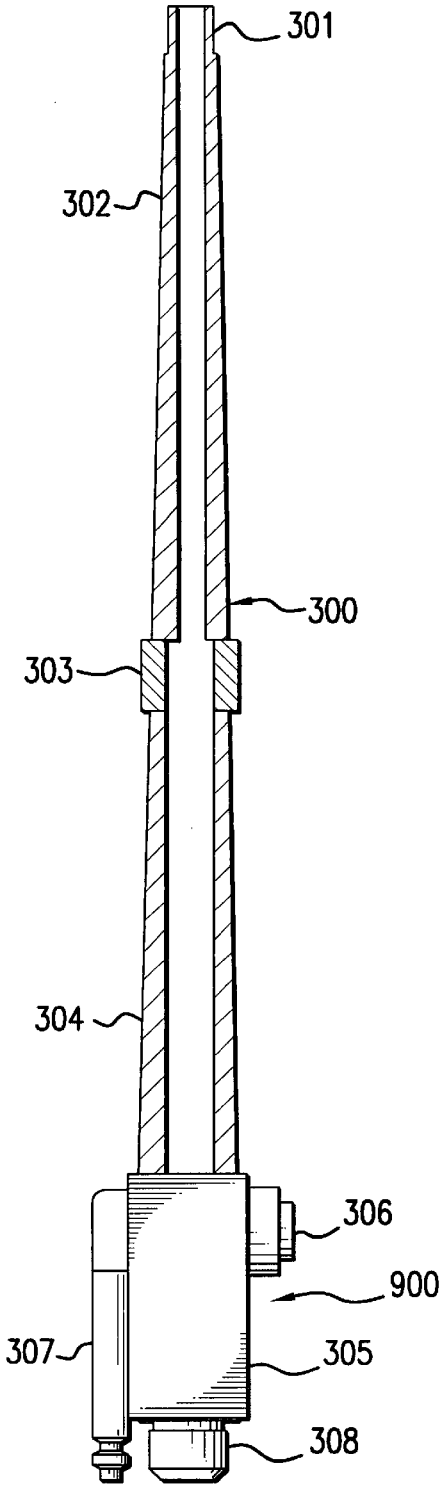
Figure 13:
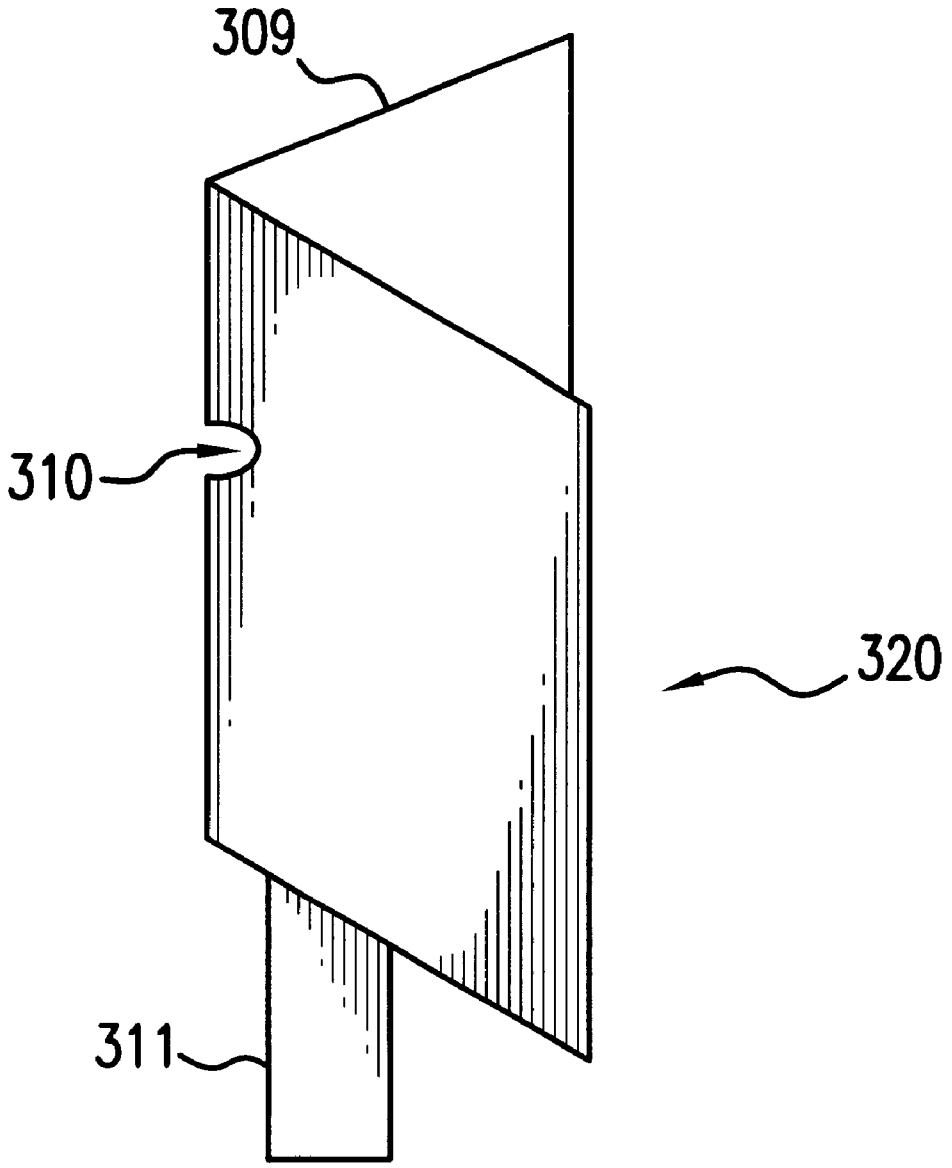
FIG. 13 is a perspective view of a corner tool in accordance with an embodiment of the present invention.

Referring to FIGS. 12*a* and 12*b*, the wand tool 300 is used to apply drywall mud to seams. The tool 300 is a hollow, elongated tool with threads 301 on the distal end, material and control line fittings 307 and 308, and a control button 306. When the user covers an air release hole on the button 306, the bladder 5 in the pump 1 inflates and forces drywall material 32 out of the pump 1, through the material line 14 and the tool 300, and onto the work surface. Referring to FIG. 13, a corner tool 320 may be attached to the threaded end 301 of the wand tool 300 via a threaded end 311 of the corner tool 320. The corner tool 320 delivers drywall material 32 into corners through a hole 310. The corner-shaped blades 309 finish the corners as the tool 320 is slid back and forth over the corner seam.

Figure 14A:
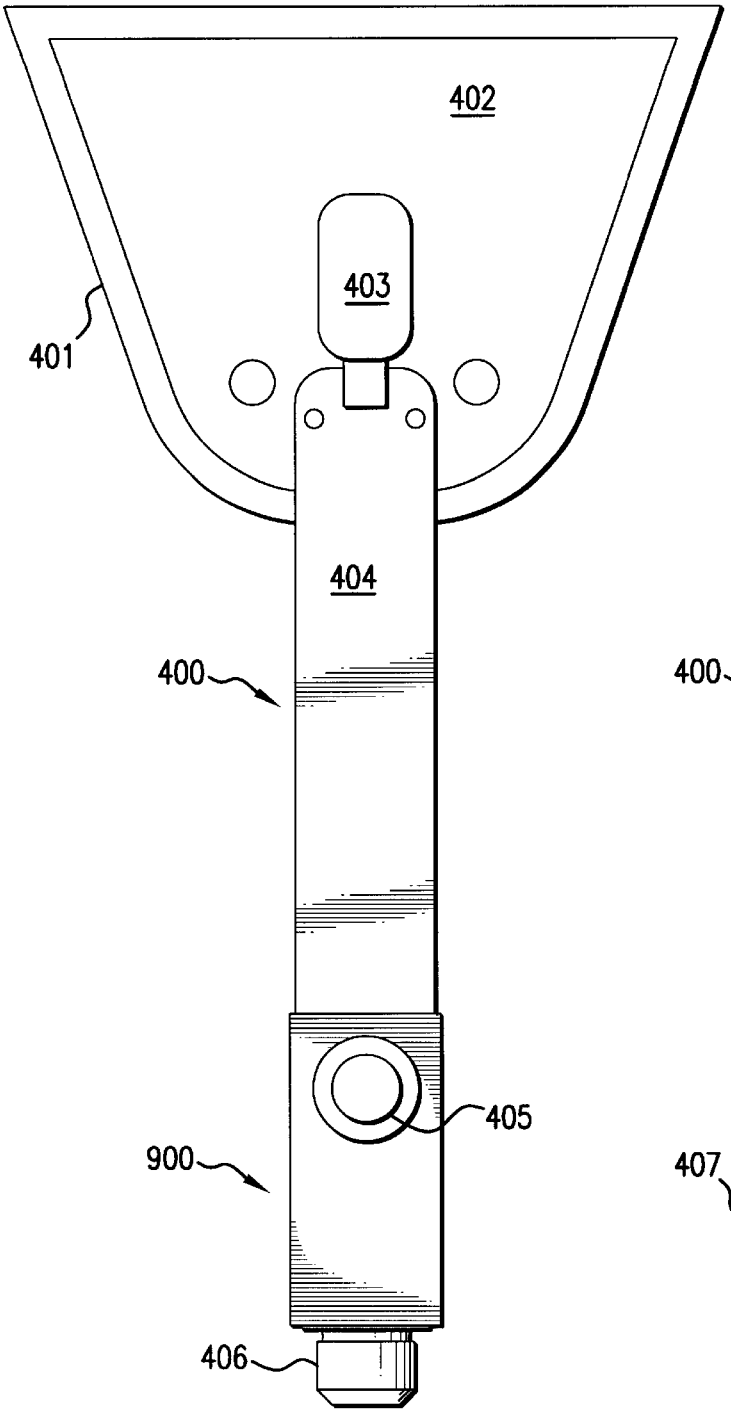
FIGS. 14*a* and 14*b* are top and side plan views of a mud knife tool in accordance with an embodiment of the present invention.
Figure 14B:
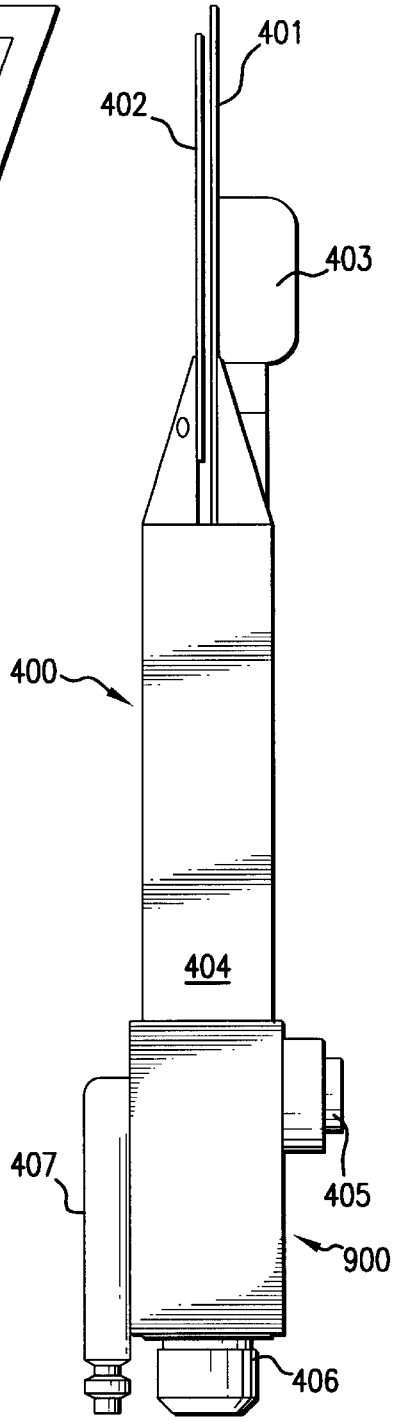

Referring to FIGS. 14 and 14*b*, the mud knife tool 400 is used for dispensing and dressing coats of mud. The tool 400 consists of a broad knife blade 401 and a smaller knife blade 402 mounted next to the broad knife blade 401. The tool also has a handle 404, material and control line fittings 406 and 407, and a control button 405. When the user covers an air release hole on the button 405, the bladder 5 inflates and forces drywall material 32 out of the pump 1, through the material line 14, and to the mud knife tool 400, where the mud valve 403 is activated when the blades 402 and 401 are flexed against the work surface.

Figure 15A:
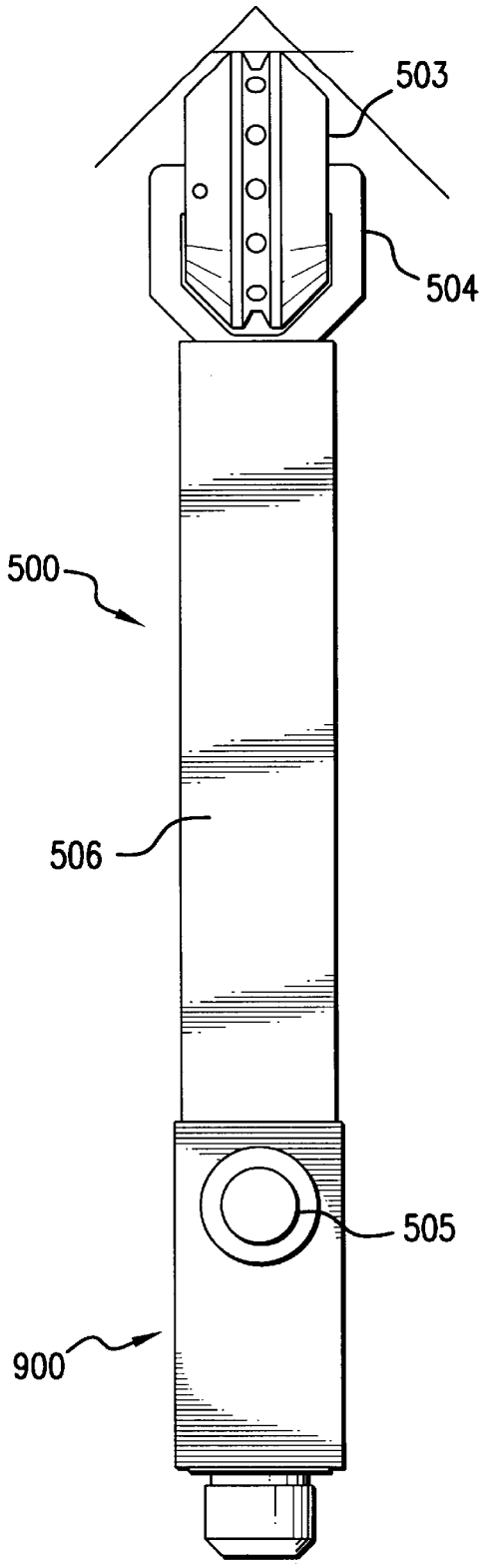
FIGS. 15*a* and 15*b* are top and side plan views of a mud bead tool in accordance with an embodiment of the present invention.
Figure 15B:
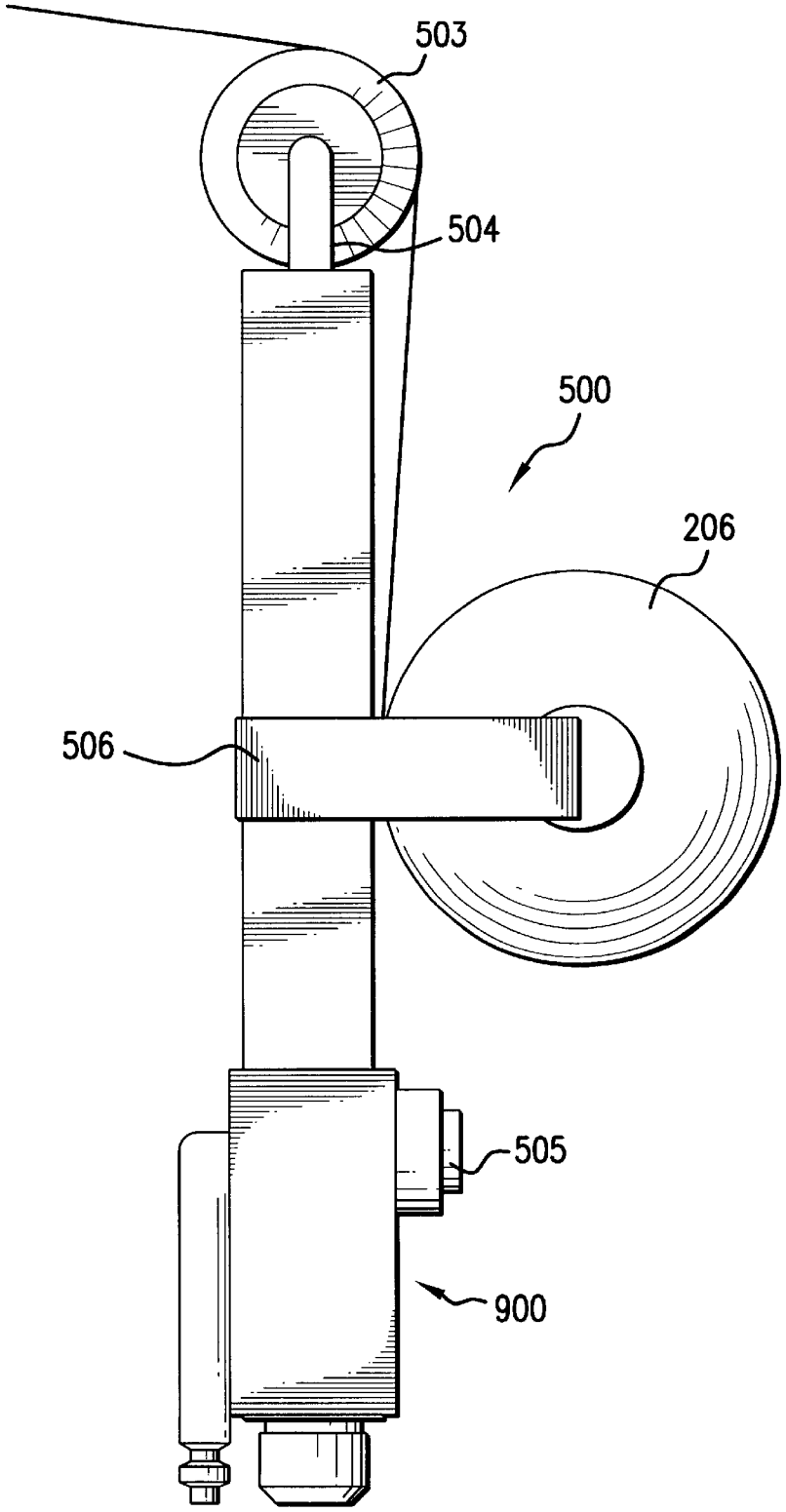
Figure 16A:
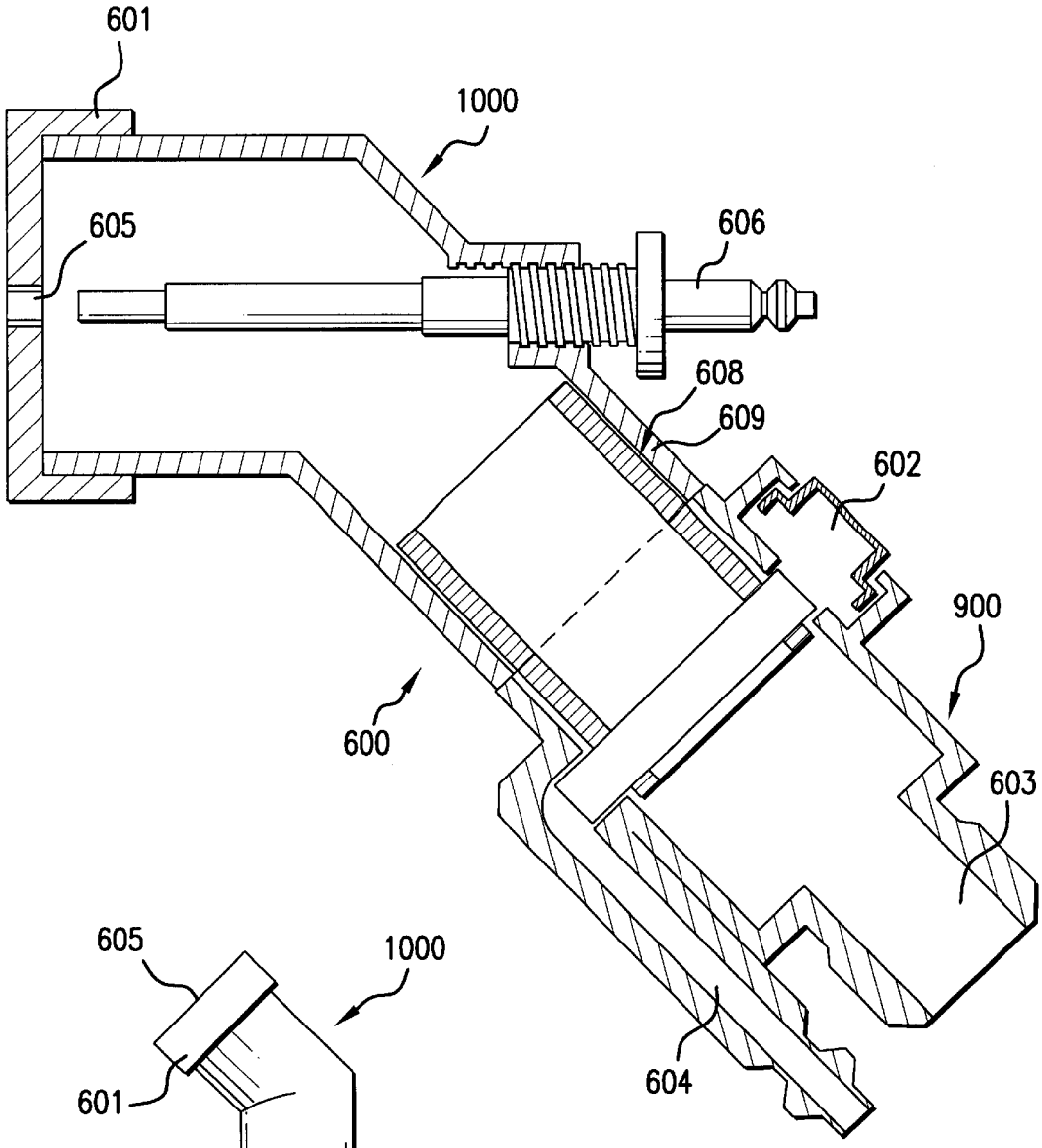
FIGS. 16*a* and 16*b* are cross-sectional and perspective views of a wall texture spray tool in accordance with an embodiment of the present invention.
Figure 16B:
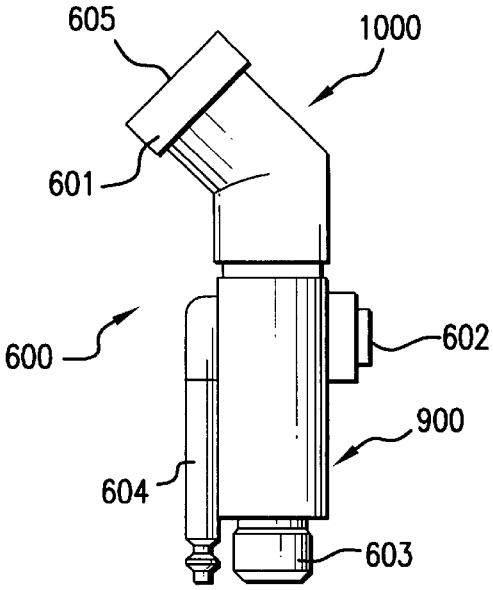
Figure 17A:
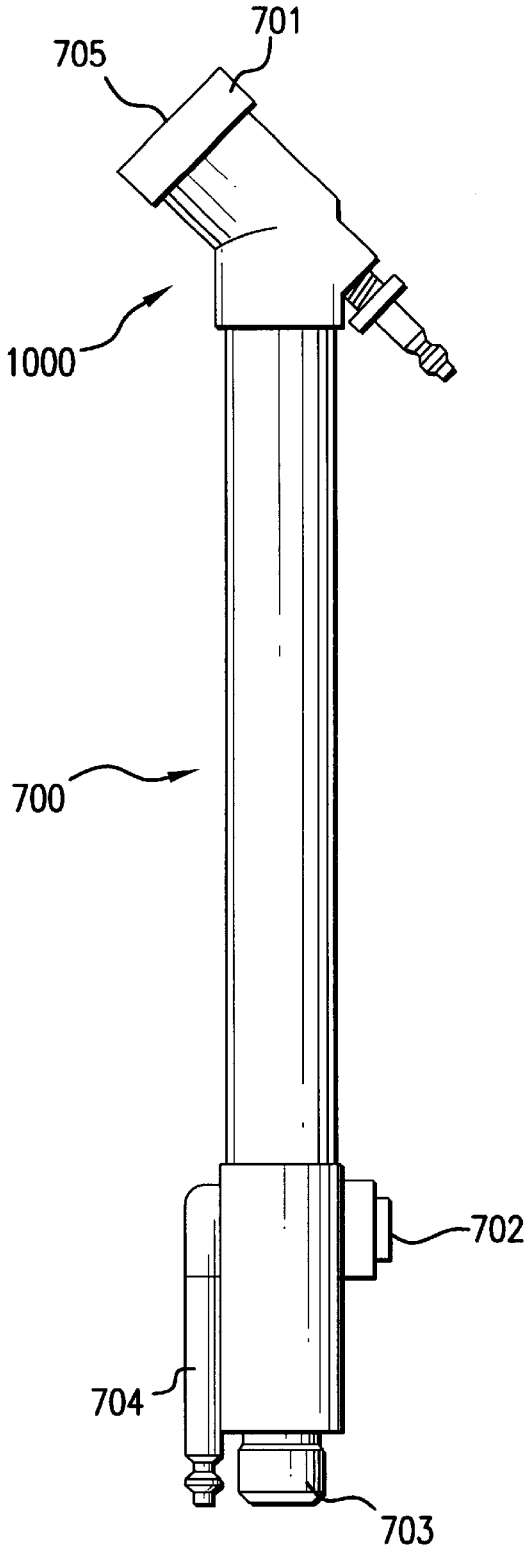
FIGS. 17*a* and 17*b* are perspective views of an acoustic texture spray tool in accordance with an embodiment of the present invention.
Figure 17B:
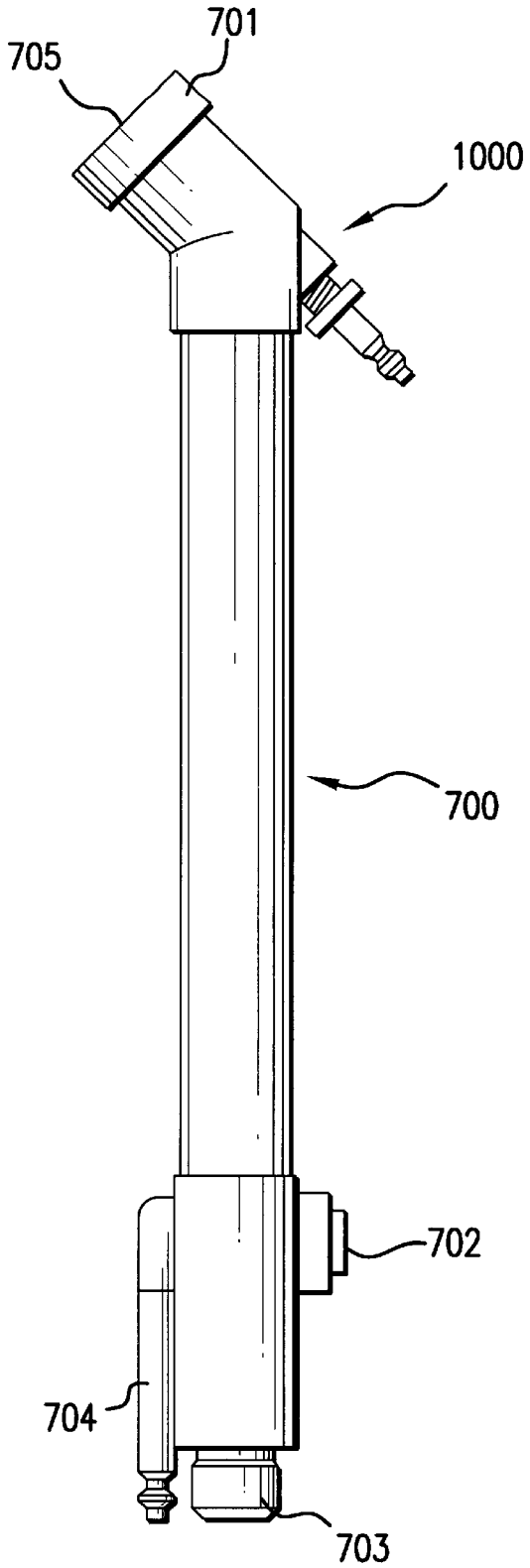
Figure 18A:
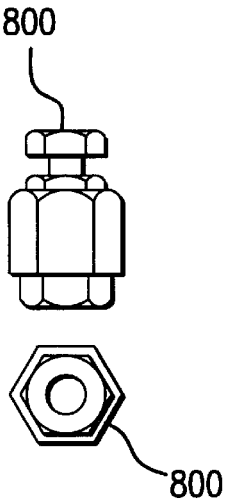
FIGS. 18*a*–18*c* are views of adapter parts that allow use of the pump with Ames Tool Company's tools in accordance with an embodiment of the present invention.
Figure 18B:
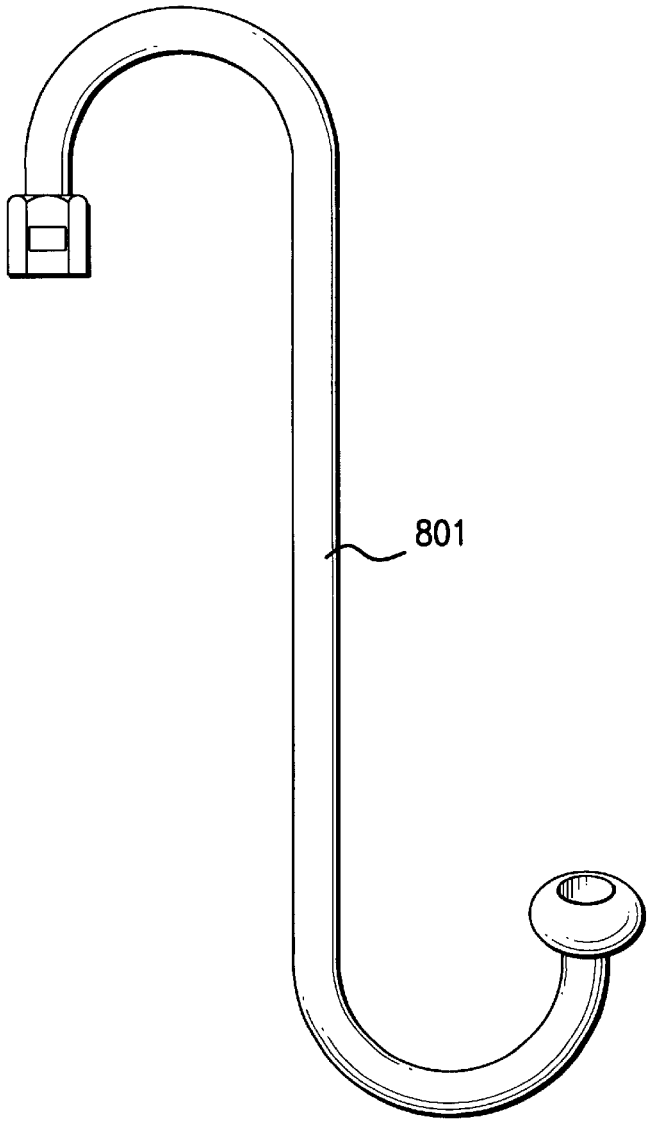
Figure 18C:
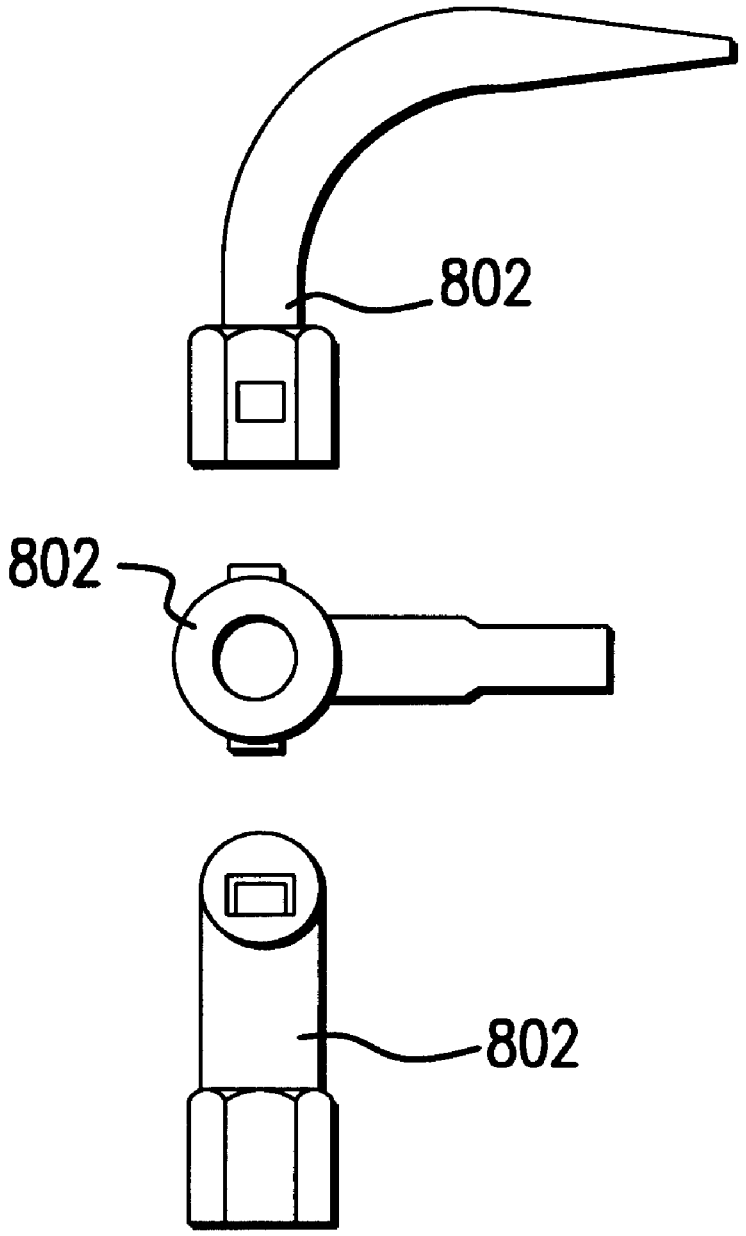
Figure 19A:
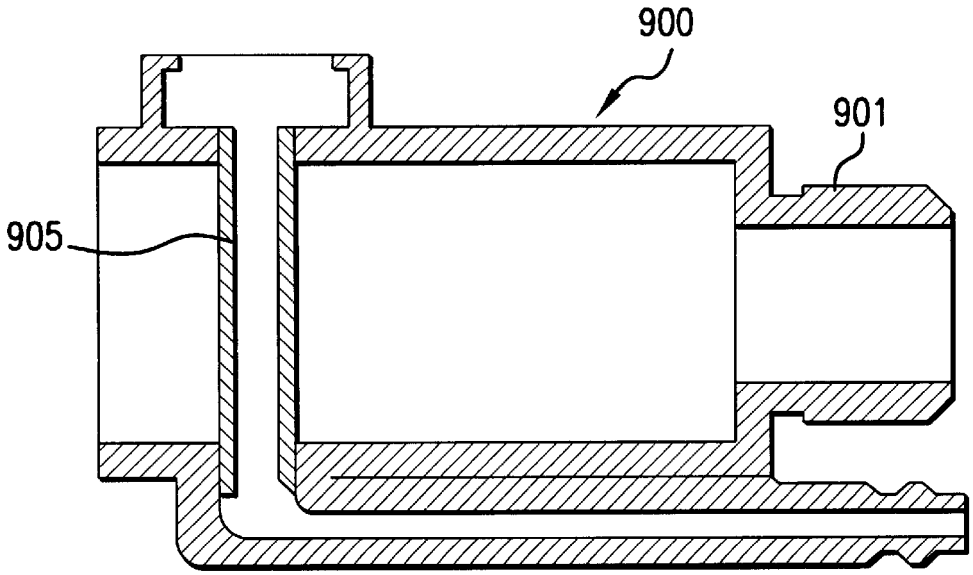
FIGS. 19*a*–19*e* are views of an universal tool fitting part in accordance with an embodiment of the present invention.
Figure 19B:
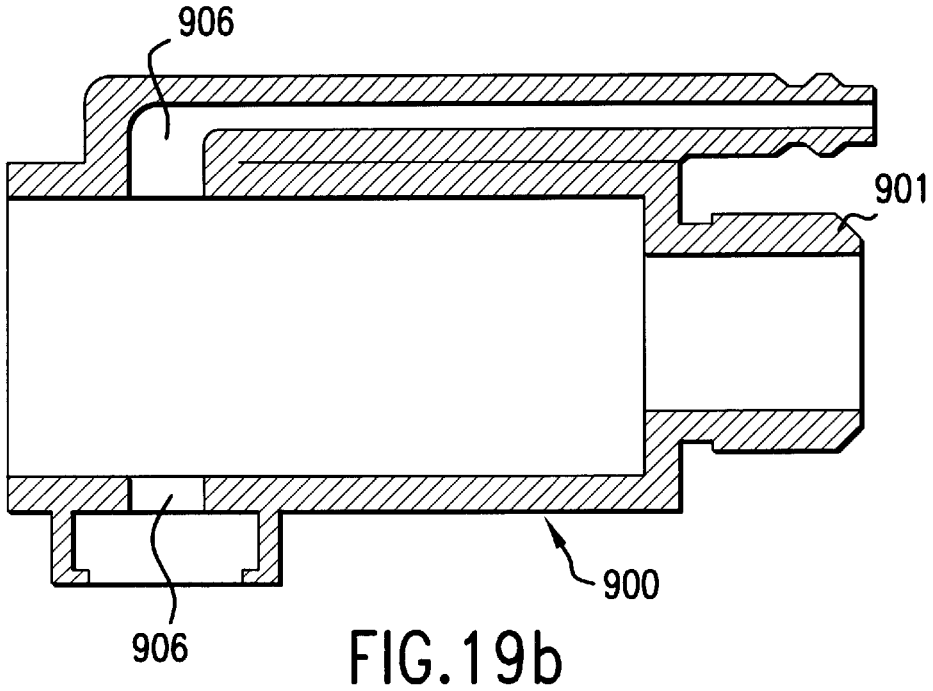
Figure 19C:
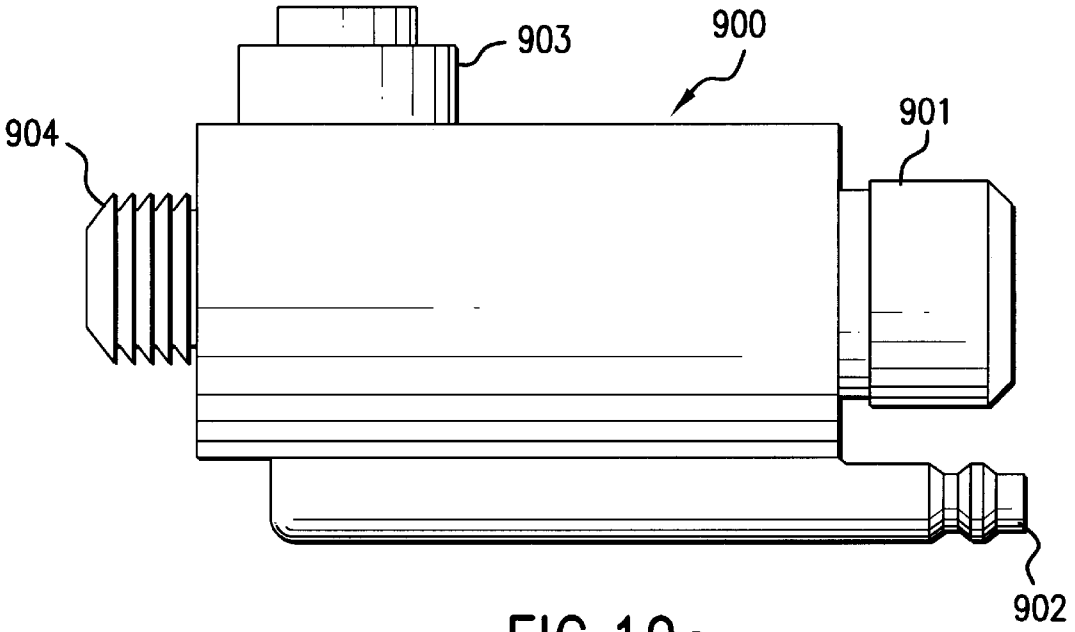
Figure 19D:
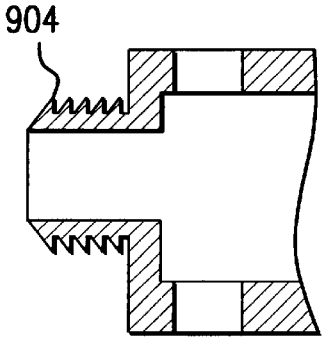
Figure 19E:
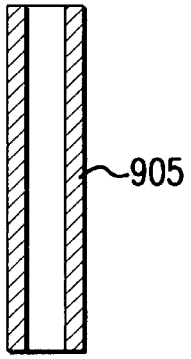

As illustrated in FIGS. 15*a* and 15*b*, the mud bead tool 500 is used to measure a distance rolled and to apply a bead of mud for other tools. The tool 500 consists of an elongated hollow body 506, material and control line fittings 501 and 502, a control button 507, and a wheel 503 on the distal end of the tool 500 that is rolled upon the work surface. As the wheel 503 is rolled upon the work surface and the control button 507 is depressed, drywall material 32 flows out of the distal end of the mud bead tool 500. When a radial hole in the wheel 503 is momentarily aligned with a radial hole in a hollow axle 504, air is released, causing the bladder to deflate and drywall material 32 to flow into the pump 1 from the container. The resulting effect is periods of pressurization and quick periods of depressurization. A tape roll holder 506 that supports a roll of drywall tape 206 may be attached to the mud bead tool 500 to form a tape applicator tool. A pneumatic cutter 320 may also be attached to the mud bead tool 500.

In addition to the tools described above, the pump 1 may be used with tools manufactured by the Ames Tool Company. A set of three parts is required to convert the pump 1 to this use. The control line 15 is replaced with an adapter button 800, and the material line 14 is replaced with an adapter gooseneck 801 and an adapter box filler part 802. These parts make the drywall taping and texture system backwards compatible with the Ames Tool Company's tools.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A drywall taping and texture system for pumping drywall mastic material from a container filled with the drywall mastic material to a work surface, the system comprising:

a pump housing immersed in the container filled with the drywall mastic material;

an air compressor connected to the pump housing;

a tool for applying the drywall mastic material to the work surface;

a material line connected between the pump housing and the tool such that there is material flow communication therebetween;

a control line connected between the pump housing and the tool such that there is air flow communication therebetween;

an inflatable bladder mounted within the pump housing between upper and lower valves for controlling the flow of the drywall mastic material;

an air release mechanism; and an airway connecting the air compressor, the control line, the bladder, and the air release mechanism, such that there is air flow communication therebetween;

wherein when the air release mechanism closes, the bladder inflates and expands radially and vertically relative to the housing such that drywall mastic material in the pump housing is pumped through the upper valve, the material line, and the tool to the work surface, wherein when the air release mechanism opens, the bladder deflates and retracts radially and vertically relative to the housing such that drywall mastic material in the container is pumped through the lower valve into the pump housing.

2. The drywall taping and texture system of claim 1, wherein the tool includes a button for remotely controlling the air release mechanism.

3. The drywall taping and texture system of claim 1, wherein the air release mechanism is a button with a hole connected to the tool and the control line, and further wherein the air release mechanism closes when the hole is covered, and the air release mechanism opens when the hole is uncovered.

4. The drywall taping and texture system of claim 1, wherein the upper and lower valves for controlling the flow of the drywall mastic material are check valves creating a one-way flow of the drywall mastic material upward through the pump housing.

5. The drywall taping and texture system of claim 1, wherein each of the upper and lower valves for controlling the flow of the drywall mastic material comprises:

a seat having an orifice through which the drywall mastic material flows; and a member for controlling the flow of the drywall mastic material through the orifice;

wherein the member mates with the seat such that a seal is formed to block the flow of the drywall mastic material through the orifice, and wherein the member moves in a direction transverse to the seat to allow the flow of the drywall mastic material through the orifice.

6. The drywall taping and texture system of claim 1, wherein the pump housing further includes a screen mounted at the bottom thereof for filtering particles out of the drywall mastic material.

7. An apparatus for pumping a fluid, the apparatus comprising:

a housing;

an inflatable bladder mounted within the housing between upper and lower valves for controlling the flow of the fluid; and a means for inflating and deflating the bladder;

wherein when the bladder is inflated, the bladder is expanded radially and vertically relative to the housing and the fluid in the housing is pumped through the upper valve and out of the apparatus, wherein when the bladder deflates, the bladder retracts radially and vertically relative to the housing and the fluid is pumped through the lower valve into the housing.

8. The apparatus of claim 7, wherein the means for inflating and deflating the bladder is an air compressor connected to the housing and the bladder.

9. The apparatus of claim 7, wherein the apparatus further includes an air line connected between the bladder and the means for inflating and deflating the bladder.

10. The apparatus of claim 9, wherein the bladder and the air line are secured between a plurality of clips.

11. The apparatus of claim 7, wherein the upper and lower valves for controlling the flow of the fluid are check valves creating a one-way flow of the fluid upward through the housing.

12. The apparatus of claim 7, wherein each of the upper and lower valves for controlling the flow of the fluid comprises:

a seat having an orifice through which the fluid flows; and a member for controlling the flow of the fluid through the orifice;

wherein the member mates with the seat such that a seal is formed to block the flow of the fluid through the orifice, and wherein the member moves in a direction transverse to the seat to allow the flow of the fluid through the orifice.

13. The apparatus of claim 12, wherein the seat further includes a raised ring for mating with the member.

14. The apparatus of claim 12, wherein the member for controlling the flow of the fluid through the orifice is a ball.

15. The apparatus of claim 14, wherein the ball is made from a heavyweight material and is covered with a soft elastomeric material.

16. The apparatus of claim 7, wherein the housing further includes a screen mounted at the bottom thereof for filtering particles out of the fluid.

* * * * *